US008702457B2

(12) United States Patent
Minoura et al.

(10) Patent No.: US 8,702,457 B2
(45) Date of Patent: Apr. 22, 2014

(54) VESSEL PROPULSION APPARATUS

(75) Inventors: Minoru Minoura, Shizuoka (JP); Nobuharu Oota, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 9 days.

(21) Appl. No.: 13/454,238

(22) Filed: Apr. 24, 2012

(65) Prior Publication Data

US 2013/0237106 A1 Sep. 12, 2013

(30) Foreign Application Priority Data

Mar. 7, 2012 (JP) ..... 2012-050907

(51) Int. Cl.
*B63H 11/11* (2006.01)

(52) U.S. Cl.
USPC ..... 440/41; 440/42

(58) Field of Classification Search
USPC ..... 440/38, 40, 41, 42, 43
See application file for complete search history.

(56) References Cited

U.S. PATENT DOCUMENTS

| | | | | |
|---|---|---|---|---|
| 5,304,078 | A | 4/1994 | Kaneko | |
| 5,752,864 | A | 5/1998 | Jones et al. | |
| 6,652,332 | B1 * | 11/2003 | Westhoff | 440/41 |
| 7,029,344 | B2 * | 4/2006 | Tsumiyama et al. | 440/41 |
| 7,217,165 | B2 * | 5/2007 | Roos | 440/41 |
| 7,347,752 | B2 * | 3/2008 | Morvillo | 440/41 |
| 2011/0159752 | A1 | 6/2011 | Ota et al. | |

* cited by examiner

*Primary Examiner* — Lars A Olson
(74) *Attorney, Agent, or Firm* — Keating & Bennett, LLP

(57) ABSTRACT

A vessel propulsion apparatus includes a nozzle, a deflector, a reverse bucket, and a guide. In a state in which the reverse bucket is positioned at a closed position and the deflector is positioned at a straight drive position, the guide generates a right branch stream flowing in an obliquely forward right direction and a left branch stream flowing in an obliquely forward left direction. In a state in which the reverse bucket is positioned at the closed position and the deflector is positioned at a right side, the guide generates the left branch stream. In a state in which the reverse bucket is positioned at the closed position and the deflector is positioned at a left side, the guide generates the right branch stream.

9 Claims, 22 Drawing Sheets

FIG. 11A Reverse
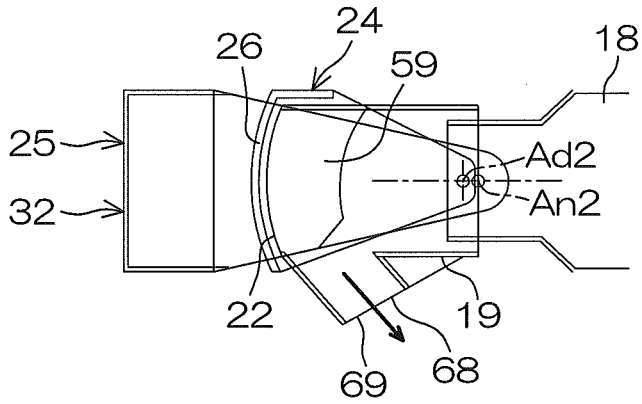
FIG. 11B Neutral
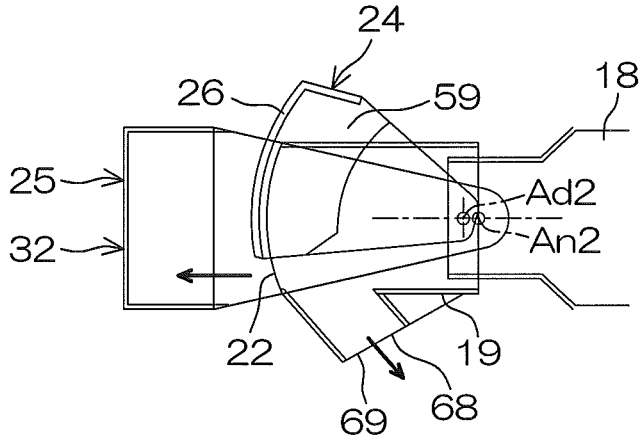

FIG. 11C Forward/low speed state
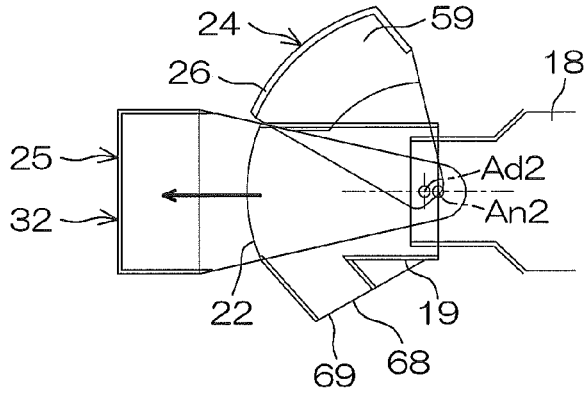
FIG. 11D Forward/medium speed state
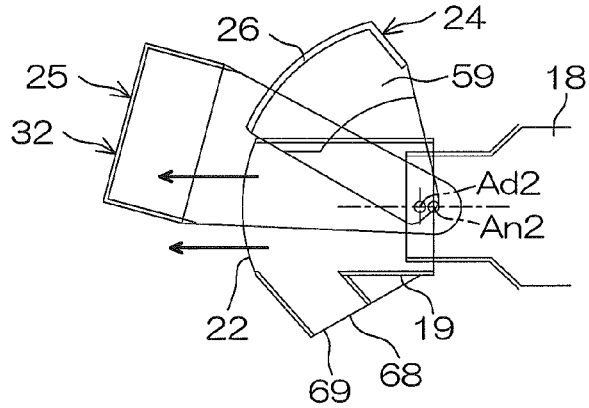
FIG. 11E Forward/high speed state
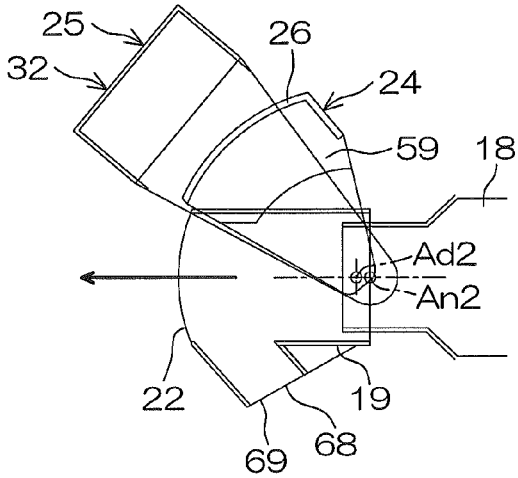

FIG. 14A Reverse
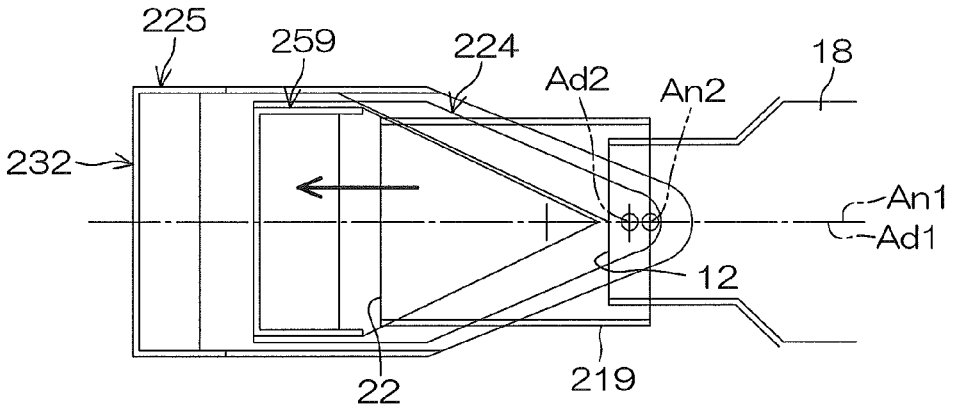
FIG. 14B Neutral
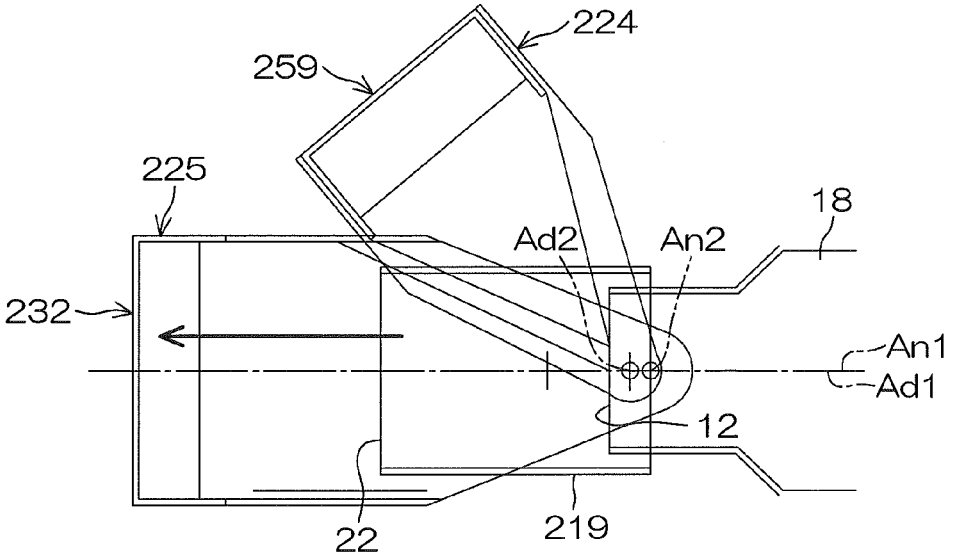

FIG. 14C Forward/low speed state
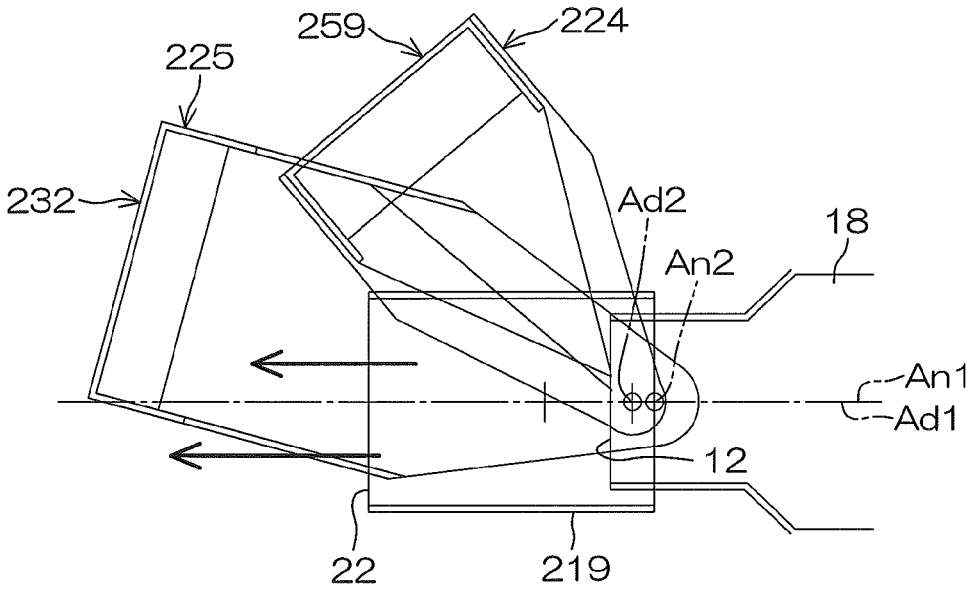
FIG. 14D Forward/high speed state
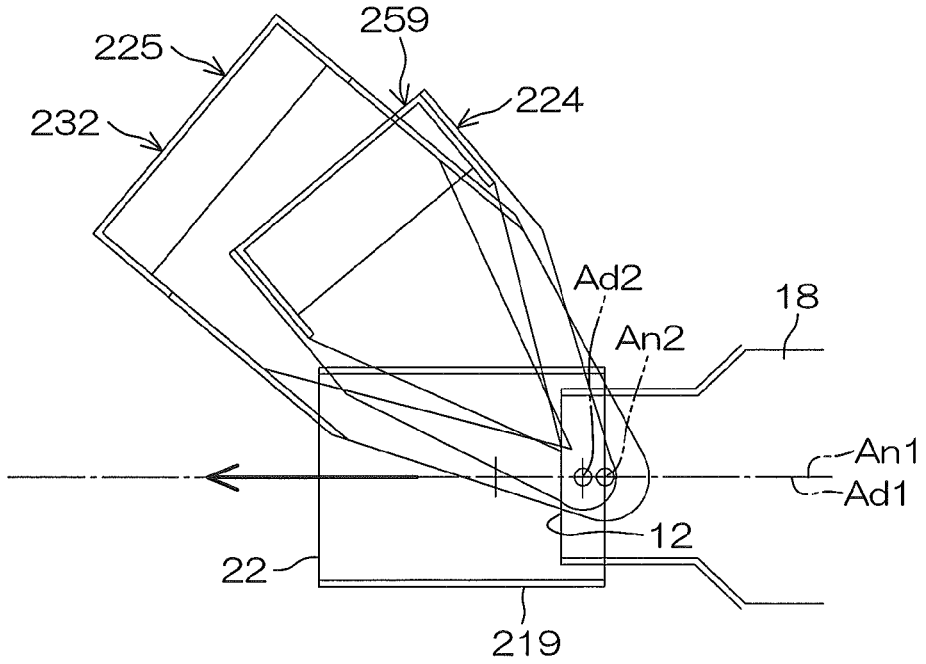

FIG. 19A Reverse
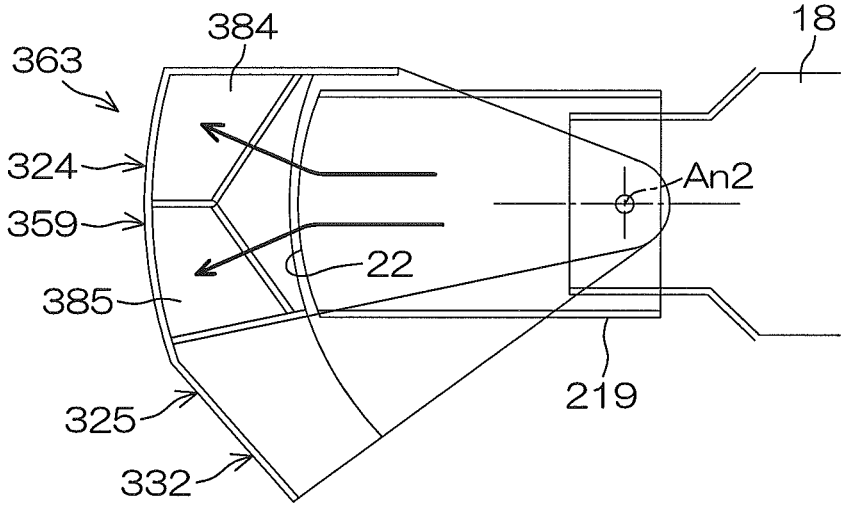
FIG. 19B Neutral
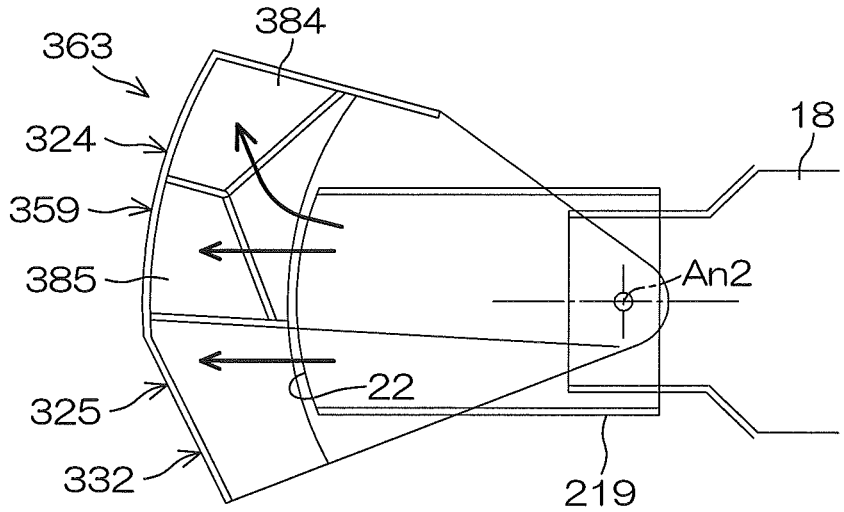

FIG. 19C Forward/low speed state
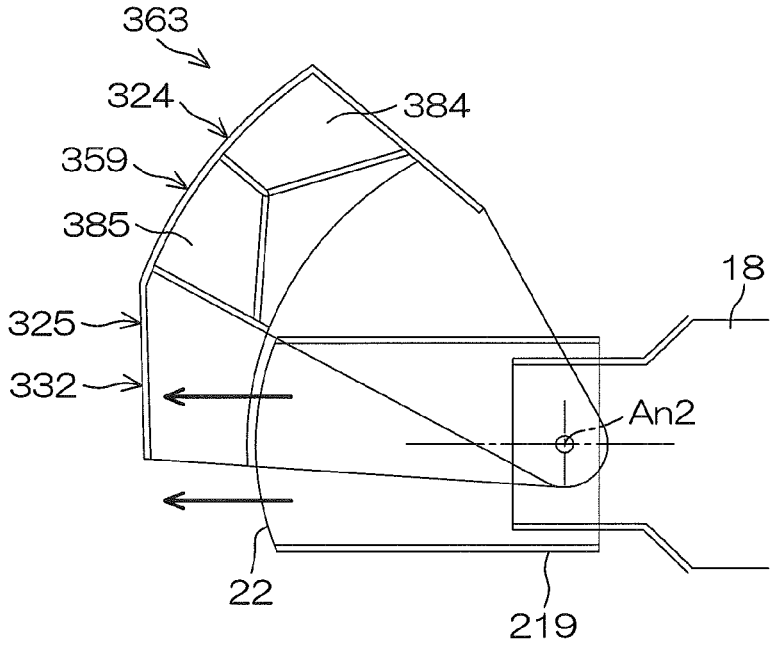
FIG. 19D Forward/high speed state
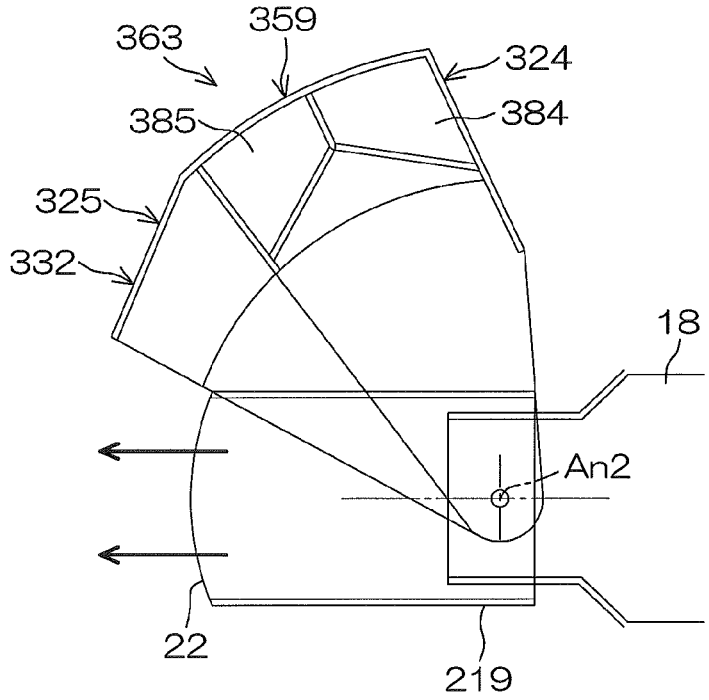

VESSEL PROPULSION APPARATUS

BACKGROUND OF THE INVENTION

1. Field of the Invention

The present invention relates to a vessel propulsion apparatus.

2. Description of the Related Art

U.S. Pat. No. 5,304,078 discloses a jet propulsion apparatus that includes a deflector (steering nozzle) that rotates right and left with respect to a discharge nozzle and a reverse thrust bucket that is held by the deflector and rotates up and down.

U.S. Pat. No. 5,752,864 discloses a jet propulsion apparatus that includes a deflector (rudder) that rotates right and left with respect to a nozzle and a reverse bucket (reverse gate) that is held by the nozzle and rotates up and down.

U.S. Patent Application Publication No. 2011/0159752 A1 describes a vessel that includes two jet propulsion apparatuses. Each jet propulsion apparatus includes a deflector that rotates right and left with respect to a nozzle and a reverse bucket that is held by the nozzle and rotates up and down.

SUMMARY OF THE INVENTION

The inventors of preferred embodiments of the present invention described and claimed in the present application conducted an extensive study and research regarding a vessel propulsion apparatus, such as the ones described above, and in doing so, discovered and first recognized new unique challenges and previously unrecognized possibilities for improvements as described in greater detail below.

Specifically, with U.S. Pat. No. 5,304,078, water is jetted rearward from the nozzle in a state in which the reverse bucket is lowered and the deflector is tilted to the right or left. Water that flows into the deflector in this state is jetted obliquely forward to the right or obliquely forward to the left from the deflector. A vessel is thereby propelled obliquely rearward to the right or obliquely rearward to the left. However, the jet propulsion apparatus according to U.S. Pat. No. 5,304,078 cannot generate a water stream that is tilted further outward than a maximum rotation angle of the deflector with respect to the nozzle, and thus, to further increase a right/left direction component of thrust, an output of an engine or other power source must be increased.

With U.S. Pat. No. 5,752,864, water is jetted rearward from the nozzle in a state in which the reverse bucket is lowered and the deflector is tilted to the right. Water that flows into the deflector is jetted obliquely rearward to the right from the deflector. As shown in FIG. 7 of U.S. Pat. No. 5,752,864, the water jetted from the deflector is guided forward by the reverse bucket and is jetted obliquely forward to the right from the reverse bucket. A vessel is thereby propelled obliquely rearward to the left. On the other hand, in a state in which the reverse bucket is raised and the deflector is tilted to the right, the water jetted from the deflector is not blocked by the reverse bucket and flows obliquely rearward to the right. The vessel is thus propelled obliquely forward to the right. That is, the vessel turns in a direction opposite to that in the case where the reverse bucket is lowered.

The jet propulsion apparatus according to U.S. Pat. No. 5,752,864 can tilt a water stream further outward than a maximum rotation angle of the deflector. However, in the state in which the reverse bucket is lowered, the vessel turns in the direction opposite to that in the state in which the reverse bucket is raised, even when the tilt direction of the deflector is the same. Thus, a relationship of a steering direction (direction of operation of a steering handle) and a turning direction of the vessel differs during forward drive and reverse drive.

With U.S. Patent Application Publication No. 2011/0159752 A1, water is jetted rearward from the pair of nozzles in a state in which the pair of reverse buckets are lowered and the pair of deflectors are tilted to the right. As shown in FIG. 21 of U.S. Patent Application Publication No. 2011/0159752 A1, water that flows into the deflector at the right side is jetted in a forward direction and an obliquely rearward left direction and water that flows into the deflector at the left side is jetted in an obliquely forward left direction. The vessel is thereby propelled obliquely rearward to the right. As shown in FIG. 22 of U.S. Patent Application Publication No. 2011/0159752 A1, in a state in which the pair of deflectors are tilted to the left, water that flows into the deflector at the right side is jetted in an obliquely forward right direction and water that flows into the deflector at the left side is jetted in the forward direction and an obliquely rearward right direction. The vessel is thereby propelled obliquely rearward to the left.

The two jet propulsion apparatuses according to U.S. Patent Application Publication No. 2011/0159752 A1 can tilt water streams further outward than the maximum rotation angles of the deflectors. Further, the relationship of the steering direction and the turning direction of the vessel is matched during forward drive and reverse drive. However, with U.S. Patent Application Publication No. 2011/0159752 A1, the vessel is propelled obliquely rearward to the right or obliquely rearward to the left by a resultant force of thrusts generated by the two jet propulsion apparatuses and, thus, two jet propulsion apparatuses (jet pumps) are necessary.

In order to overcome the previously unrecognized and unsolved challenges described above, a preferred embodiment of the present invention provides a vessel propulsion apparatus that includes a nozzle, a deflector, a reverse bucket (hereinafter referred to as the "R bucket"), and a guide. The nozzle jets water rearward. The deflector is rotatable to the right and left around a substantially vertical axis and between a right maximum steering position and a left maximum steering position. The deflector defines an outlet by which water jetted from the nozzle is jetted in a rearward direction or an obliquely rearward direction tilted to the right or left with respect to the rearward direction. The R bucket is rotatable up and down around a substantially horizontal axis and between a closed position covering at least a portion of the outlet in a rear view and an opened position not covering the outlet. In a state in which the R bucket is positioned at the closed position and the deflector is positioned at a straight drive position between the right maximum steering position and the left maximum steering position, water flowing into the deflector from the nozzle is divided at equal or substantially equal flow rates to the right and left by the guide. A right branch stream flowing in an obliquely forward right direction and a left branch stream flowing in an obliquely forward left direction are thus generated by the guide. Further, in a state in which the R bucket is positioned at the closed position and the deflector is positioned at a right side relative to the straight drive position, the guide generates the left branch stream to have a greater flow rate than the right branch stream. Further, in a state in which the R bucket is positioned at the closed position and the deflector is positioned at a left side relative to the straight drive position, the guide causes the right branch stream to have a greater flow rate than the left branch stream.

With this arrangement of a present preferred embodiment of the present invention, water jetted rearward from the nozzle passes through the deflector and is jetted rearward from the outlet of the deflector. The R bucket is rotatable up and down around the substantially horizontal axis and between the closed position covering at least a portion of the outlet in a rear view and the opened position not covering the outlet.

In a state in which the R bucket is positioned at the opened position, the outlet is not covered and the water jetted from the outlet flows rearward without being blocked by the R bucket. The deflector is rotatable to the right and left around the substantially vertical axis and between the right maximum steering position and the left maximum steering position. The right maximum steering position and the left maximum steering position are positions at which water is jetted from the outlet in obliquely rearward directions that are tilted to the right and left with respect to the rearward direction. The straight drive position between the right maximum steering position and the left maximum steering position is a position at which water is jetted in the rearward direction from the outlet. The direction of jetting of water from the outlet changes in accordance with the movement of the deflector around the substantially vertical axis. A water stream that flows rearward from the nozzle is thus tilted to the right or left by the deflector.

On the other hand, in the state in which the R bucket is positioned at the closed position and the deflector is positioned at the right side relative to the straight drive position, the water guided obliquely rearward to the right by the deflector is guided in the obliquely forward left direction by the guide. The left branch stream flowing in the obliquely forward left direction is thereby generated and the vessel is propelled obliquely rearward to the right. Also, in the state in which the R bucket is positioned at the closed position and the deflector is positioned at the left side relative to the straight drive position, the water guided obliquely rearward to the left by the deflector is guided in the obliquely forward right direction by the guide. The right branch stream flowing in the obliquely forward right direction is thereby generated and the vessel is propelled obliquely rearward to the left.

The water stream guided obliquely rearward to the right by the deflector is thus guided in the obliquely forward left direction by the guide and the water stream guided obliquely rearward to the left by the deflector is thus guided in the obliquely forward right direction by the guide. Thus, a relationship of a steering direction (direction of operation of a steering handle) and a turning direction of the vessel does not differ between forward drive and reverse drive. Further, the obliquely forward right direction and the obliquely forward left direction are directions that are tilted to the right and left further than directions of jetting of water from the outlet at the maximum steering positions. The vessel propulsion apparatus can thus tilt a water stream further outward than a maximum rotation angle of the deflector. Thus, a large force that turns the vessel in a reverse drive state can be produced by the vessel propulsion apparatus.

The substantially horizontal axis may be an axis that is fixed with respect to the deflector. The guide may generate the left branch stream from a water stream that flows further to the left than a central axis of the deflector in the state in which the R bucket is positioned at the closed position and the deflector is positioned at the straight drive position. Further, in this state, the guide may generate the right branch stream from a water stream that flows further to the right than the central axis of the deflector.

The R bucket may include a lid portion that covers the outlet at the closed position. The guide may be a portion of the R bucket and include a plate-shaped member that extends forward from the lid portion.

The deflector may include a main flow passage by which the water jetted from the nozzle is guided rearward toward the outlet, a right flow passage extending obliquely forward to the right and downward from the main flow passage to a right outlet, and a left flow passage extending obliquely forward to the left and downward from the main flow passage to a left outlet. In this case, in a state in which the reverse bucket is positioned at the closed position, the deflector and the reverse bucket may generate the right branch stream to flow through a flow passage defined by a portion of the main flow passage at a right side relative to the plate-shaped member, a portion of the lid portion at a right side relative to the plate-shaped member, and the right flow passage. Likewise, in the state in which the reverse bucket is positioned at the closed position, the deflector and the reverse bucket may generate the left branch stream to flow through a flow passage defined by a portion of the main flow passage at a left side relative to the plate-shaped member, a portion of the lid portion at a left side relative to the plate-shaped member, and the left flow passage.

Also, in the state in which the reverse bucket is positioned at the closedposition, the deflector and the reverse bucket may generate the right branch stream to pass through the outlet. Likewise, in the state in which the reverse bucket is positioned at the closed position, the deflector and the reverse bucket may generate the left branch stream to pass through the outlet.

The deflector may have a slit. In this case, the plate-shaped member may be arranged to extend into an interior of the deflector through the slit.

Also, the guide may be a portion of the R bucket and using the guide, water jetted rearward from the deflector in the state in which the R bucket is positioned at the closed position and the deflector is positioned at the straight drive position may be guided in an obliquely forward left direction and an obliquely forward right direction.

The guide may include an apex portion positioned on the central axis of the deflector in the state in which the reverse bucket is positioned at the closed position and the deflector is positioned at the straight drive position. In this case, the guide may include a U-shaped right guide that extends obliquely rearward to the right from the apex portion and then obliquely forward to the right and a U-shaped left guide that extends obliquely rearward to the left from the apex portion and then obliquely forward to the left.

Also, the substantially horizontal axis may be an axis that is fixed with respect to the nozzle. The guide may be a portion of the R bucket and generate the left branch stream from a water stream that flows further to the right than the central axis of the deflector in the state in which the R bucket is positioned at the closed position and the deflector is positioned at the straight drive position. Further, in this state, the guide may generate the right branch stream from a water stream that flows further to the left than the central axis of the deflector.

Also, in the state in which R bucket is positioned at the closed position and the deflector is positioned at the straight drive position, water jetted rearward from the deflector may be guided in the obliquely forward left direction and the obliquely forward right direction by the guide.

The guide may include a right flow passage and a left flow passage that intersect vertically. In the state in which the R bucket is positioned at the closed position and the deflector is positioned at the straight drive position, water jetted rearward from the deflector may be guided from a left side to a right side of the central axis of the deflector by the right flow passage. In the state in which the R bucket is positioned at the closed position and the deflector is positioned at the straight drive position, water jetted rearward from the deflector may be guided from the right side to the left side of the central axis of the deflector by the left flow passage.

Also, a front end of the guide may be disposed further to the rear than the substantially vertical axis.

Also, the front end of the guide may be disposed further to the rear than a rear end of the nozzle.

The above and other elements, features, steps, characteristics and advantages of the present invention will become more apparent from the following detailed description of the preferred embodiments of the present invention with reference to the attached drawings.

BRIEF DESCRIPTION OF THE DRAWINGS

FIG. 11A is a schematic side view describing an example of a relationship of a position of the lever and positions of the R bucket and the F bucket.

FIG. 11B is a schematic side view describing an example of a relationship of the position of the lever and the positions of the R bucket and the F bucket.

FIG. 11C is a schematic side view describing an example of a relationship of the position of the lever and the positions of the R bucket and the F bucket.

FIG. 11D is a schematic side view describing an example of a relationship of the position of the lever and the positions of the R bucket and the F bucket.

FIG. 11E is a schematic side view describing an example of a relationship of the position of the lever and the positions of the R bucket and the F bucket.

FIG. 14A is a schematic side view describing an example of a relationship of a position of the lever and positions of the R bucket and the F bucket.

FIG. 14B is a schematic side view describing an example of a relationship of the position of the lever and the positions of the R bucket and the F bucket.

FIG. 14C is a schematic side view describing an example of a relationship of the position of the lever and the positions of the R bucket and the F bucket.

FIG. 14D is a schematic side view describing an example of a relationship of the position of the lever and the positions of the R bucket and the F bucket.

FIG. 19A is a schematic side view describing an example of a relationship of a position of the lever and positions of the R bucket and the F bucket.

FIG. 19B is a schematic side view describing an example of a relationship of the position of the lever and the positions of the R bucket and the F bucket.

FIG. 19C is a schematic side view describing an example of a relationship of the position of the lever and the positions of the R bucket and the F bucket.

FIG. 19D is a schematic side view describing an example of a relationship of the position of the lever and the positions of the R bucket and the F bucket.

DETAILED DESCRIPTION OF THE PREFERRED EMBODIMENTS

The figures described below show vessels in a stationary state of floating still on water. In the description that follows, "front/rear direction," "right/left direction," and "up/down direction" are directions based on a hull in the stationary state. Further, in the following description, "reverse" and "forward"

are expressed as "R" and "F," respectively. For example, an "R bucket" signifies a "reverse bucket."

First Preferred Embodiment

Figure 1:
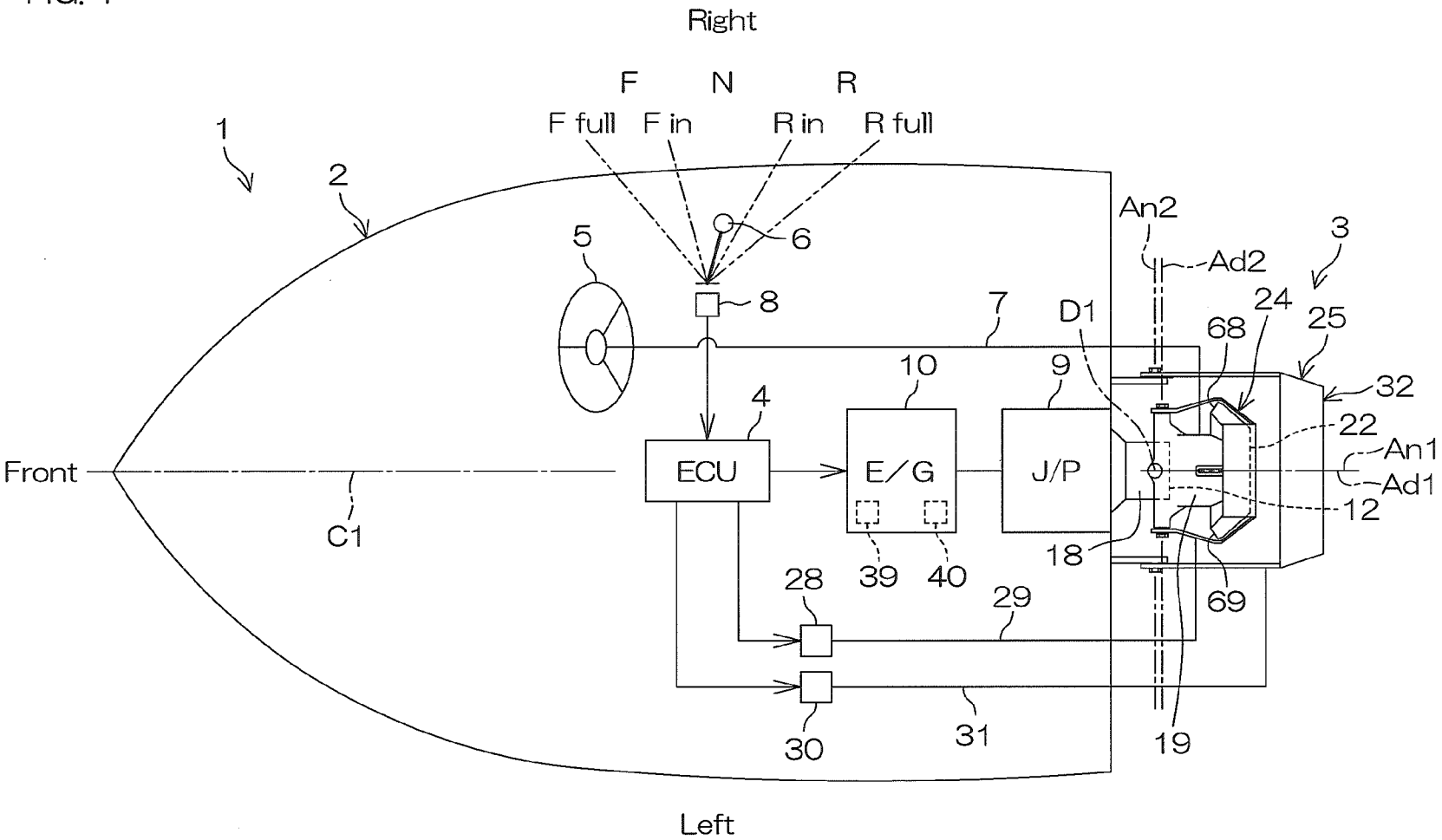
FIG. 1 is a schematic plan view of a vessel according to a first preferred embodiment of the present invention.
Figure 2:
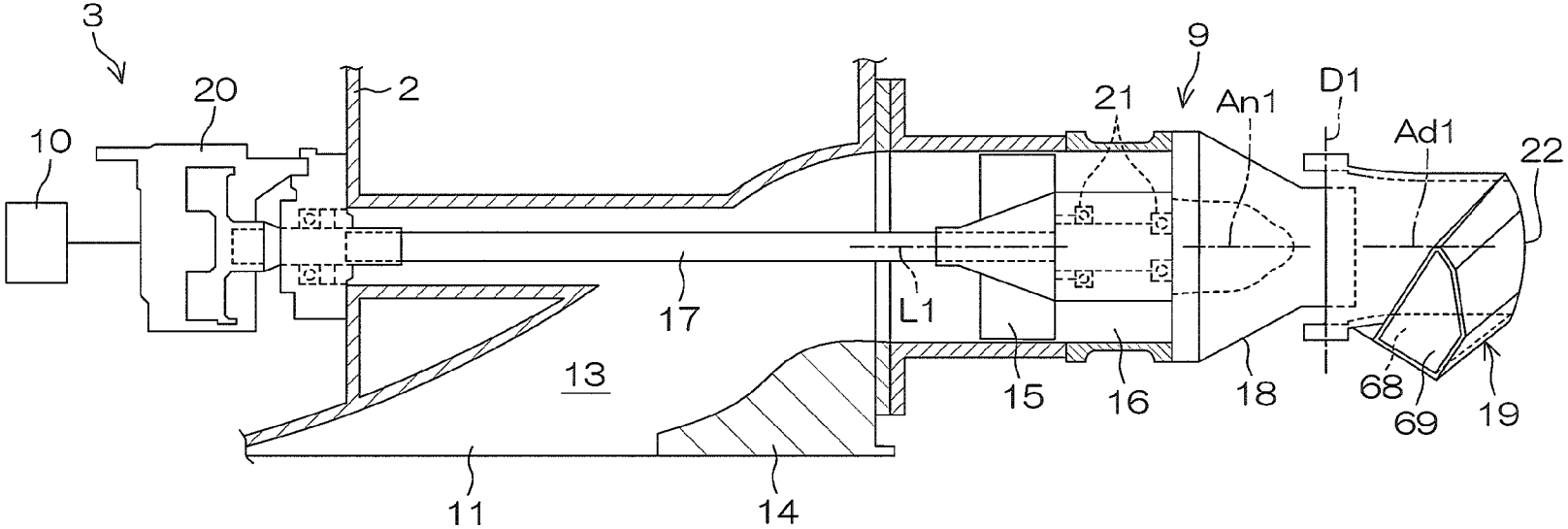
FIG. 2 is a partial sectional view of a vessel propulsion apparatus according to the first preferred embodiment of the present invention.
Figure 3:
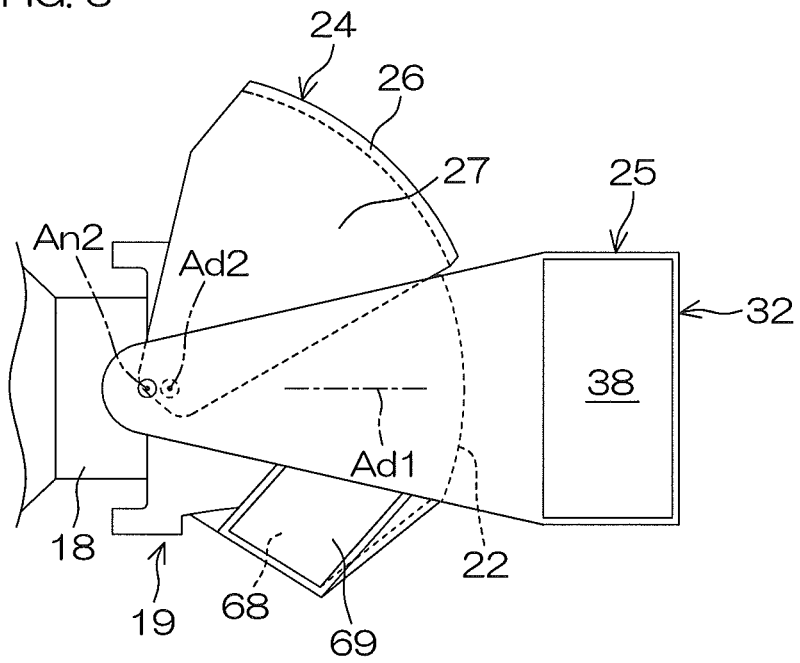
FIG. 3 is a schematic side view of an R bucket and an F bucket.
Figure 4:
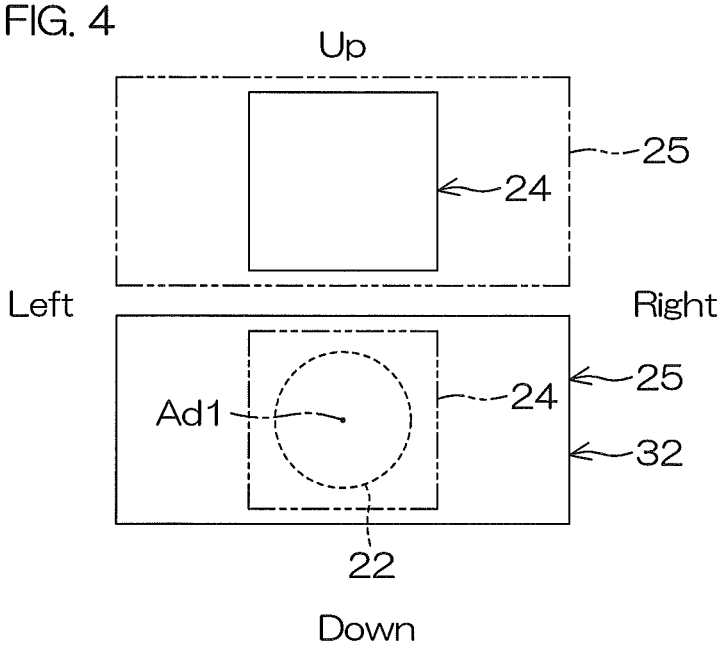
FIG. 4 is a schematic rear view of the R bucket and the F bucket.

FIG. 1 is a schematic plan view of a vessel 1 according to a first preferred embodiment of the present invention. FIG. 2 is a partial sectional view of a vessel propulsion apparatus 3 according to the first preferred embodiment of the present invention. FIG. 3 is a schematic side view of an R bucket 24 and an F bucket 25. FIG. 4 is a schematic rear view of the R bucket 24 and the F bucket 25. Illustrations of the R bucket 24 and the F bucket 25 are omitted in FIG. 2.

As shown in FIG. 1, the vessel 1 includes a hull 2, the vessel propulsion apparatus 3 that drives the hull 2 forward and in reverse, and an ECU 4 (electronic control unit) that controls the vessel propulsion apparatus 3. Further, the vessel 1 includes a handle 5 operated by a vessel operator to change a turning angle of the vessel 1 and a lever 6 operated by the vessel operator to change an output of the vessel propulsion apparatus 3.

As shown in FIG. 1, the vessel propulsion apparatus 3 is disposed at a central portion of a rear portion of the hull 2. A center in a right/left direction of the vessel propulsion apparatus 3 is matched with a hull center C1 (a vertical plane passing through a width direction center of the hull 2). The vessel propulsion apparatus 3 is a jet propulsion apparatus that jets water forward or rearward. The handle 5 is coupled to the vessel propulsion apparatus 3 by a steering cable 7. The handle 5 is movable between a right maximum steering position and a left maximum steering position. A tilt angle of a water stream with respect to a front/rear direction is changed by operation of the handle 5. Also, a position of the lever 6 is detected by a lever position detecting device 8. The ECU 4 changes the output of the vessel propulsion apparatus 3 (engine 10) based on a detection value of the lever position detecting device 8.

As shown in FIG. 1, the lever 6 is rotatable forward and rearward around its lower end portion as a center. The lever 6 is tilted forward or rearward with a substantially vertical position as a center by the vessel operator. Aneutral position N is, for example, the position at which the lever 6 is substantially vertical. When the lever 6 is tilted forward from the neutral position N to a shift switching position Fin (forward drive shift switching position), the vessel propulsion apparatus 3 is switched to generate a thrust in a forward drive direction. Also, when the lever 6 is tilted rearward from the neutral position N to a shift switching position Rin (reverse drive shift switching position), the vessel propulsion apparatus 3 is switched to generate a thrust in a reverse drive direction. A region between the shift switching position Fin and the shift switching position Rin is an N region (neutral region) in which the ECU 4 keeps the output of the vessel propulsion apparatus 3 fixed.

As shown in FIG. 1, when the lever 6 is tilted further forward from the shift switching position Fin toward a fully opened position Ffull (forward drive fully opened position), the ECU 4 increases the output of the vessel propulsion apparatus 3 in accordance with a tilt amount of the lever 6. Likewise, when the lever 6 is tilted further rearward from the shift switching position Rin toward a fully opened position Rfull (reverse drive fully opened position), the ECU 4 increases the output of the vessel propulsion apparatus 3 in accordance with the tilt amount of the lever 6. The region from the shift switching position Fin to the fully opened position Ffull is an F region (forward region) in which the ECU 4 makes the vessel propulsion apparatus 3 generate a thrust in the forward drive direction. Also, the region from the shift switching position Rin to the fully opened position Rfull is an R region (reverse region) in which the ECU 4 makes the vessel propulsion apparatus 3 generate a thrust in the reverse drive direction.

As shown in FIG. 2, the vessel propulsion apparatus 3 includes a jet pump 9 by which water sucked in from a hull bottom is jetted rearward, and an engine 10 that drives the jet pump 9. The engine 10 is an example of a power source that drives the jet pump 9. The jet pump 9 may be driven by an electric motor or by the engine 10 and the electric motor or by a device besides the engine 10 and the electric motor. The engine 10 is disposed in an interior of the hull 2. The engine 10 is controlled by the ECU 4. The jet pump 9 is disposed at the rear of the engine 10.

As shown in FIG. 2, the jet pump 9 defines an inlet 11 that opens at the hull bottom, an outlet 12 that opens further rearward at the rear than the inlet 11, and a flow passage 13 connecting the inlet 11 and the outlet 12. The jet pump 9 includes a duct 14 defining the inlet 11 and a portion of the flow passage 13, a moving vane 15 and a stationary vane 16 disposed in the flow passage 13, and a driveshaft 17 coupled to the moving vane 15. Further, the jet pump 9 includes a nozzle 18 defining the outlet 12 and a deflector 19 by which a direction of a water stream flowing rearward from the nozzle 18 is tilted to the right and left. The nozzle 18 extends in the front/rear direction along the hull center C1.

As shown in FIG. 2, the driveshaft 17 extends in the front/rear direction. A front endportion of the driveshaft 17 is coupled to the engine 10 via a coupling 20, and a rear endportion of the driveshaft 17 is rotatably supported via a plurality of bearings 21. The moving vane 15 is coupled to the driveshaft 17. The stationary vane 16 is disposed at the rear of the moving vane 15 and the nozzle 18 is disposed at the rear of the stationary vane 16. The moving vane 15 includes a plurality of blades disposed so as to surround a rotation axis L1 (central axis of the driveshaft 17). Likewise, the stationary vane 16 includes a plurality of blades disposed so as to surround the rotation axis L1. The moving vane 15 is rotatable around the rotation axis L1 with respect to the flow passage 13 and the stationary vane 16 is fixed with respect to the flow passage 13.

The moving vane 15 is driven around the rotation axis L1 together with the driveshaft 17 by the engine 10. When the moving vane 15 is driven to rotate, water is sucked into the flow passage 13 from the inlet 11 and the water sucked into the flow passage 13 is fed from the moving vane 15 to the stationary vane 16. Due to the water being fed by the moving vane 15 and passing through the stationary vane 16, twisting of the water stream resulting from the rotation of the moving vane 15 is reduced and the water stream is flow-rectified. The flow-rectified water is thus fed from the stationary vane 16 to the outlet 12. The nozzle 18 has a tubular shape extending in the front/rear direction and an inner diameter of a rear end portion of the nozzle 18 is smaller than an inner diameter of a front end portion of the nozzle 18. The outlet 12 is defined by the rear end portion of the nozzle 18. Water fed into the nozzle 18 is thus jetted rearward from the outlet 12 after being accelerated by the nozzle 18.

As shown in FIG. 2, the deflector 19 has a tubular shape extending rearward from the nozzle 18. A central axis Ad1 of the deflector 19 is disposed at the same or substantially the same height as a central axis An1 of the nozzle 18. The deflector 19 defines an F outlet 22 that is opened rearward, an R right outlet 68 that is opened obliquely forward to the right, and an R left outlet 69 that is opened obliquely forward to the left. The F outlet 22 is disposed at the rear of the outlet 12, and the R right outlet 68 and the R left outlet 69 are disposed further forward than the F outlet 22. The R right outlet 68 and the R left outlet 69 are disposed right/left symmetrically with respect to the central axis Ad1 of the deflector 19. The R right outlet 68 jets water in an obliquely forward right direction and the R left outlet 69 jets water in an obliquely forward left direction. The obliquely forward right direction is a direction with which the obliquely forward left direction is right/left inverted.

The F outlet 22 is opened and closed by the R bucket 24 to be described below. When water is jetted rearward from the nozzle 18 in a state in which the F outlet 22 is open, the water flowing into the deflector 19 is jetted rearward from the F outlet 22. A forward drive direction thrust is thereby generated. On the other hand, when water is jetted rearward from the nozzle 18 in a state in which the F outlet 22 is closed, the water flowing into the deflector 19 is guided by the R bucket 24 to at least one of either of the R right outlet 68 and the R left outlet 69 and jetted forward from at least one of either of the R right outlet 68 and the R left outlet 69. A reverse drive direction thrust is thereby generated.

As shown in FIG. 2, the deflector 19 is coupled to the nozzle 18 so as to enable rotation to the right and left around a substantially vertical axis D1 that extends in the up/down direction. The nozzle 18 is fixed to the hull 2 and does not move with respect to the hull 2. The deflector 19 is thus rotatable around the axis D1 with respect to the nozzle 18. The deflector 19 is rotated to the right or left around the axis D1 in accordance with an operation of the handle 5 by the vessel operator. When the deflector 19 is rotated to the right or left around the axis D1, a jetting direction of water jetted from the deflector 19 is changed to the right or left.

The deflector 19 is rotatable around the axis D1 and between a right maximum steering position and a left maximum steering position. The right maximum steering position is a position at which the direction of jetting of water from the deflector 19 is tilted furthest to the right, and the left maximum steering position is a position at which the direction of jetting of water from the deflector 19 is tilted furthest to the left. The right maximum steering position and the left maximum steering position are in a right/left symmetrical positional relationship. The deflector 19 is rotatable to the right and left with respect to the nozzle 18 with a straight drive position, intermediate of the right maximum steering position and the left maximum steering position, as a center. The straight drive position is a position at which the central axis Ad1 of the deflector 19 extends in the front/rear direction in a plan view and the F outlet 22 jets water in the rearward direction in a plan view. The deflector 19 is coupled to the handle 5 via the steering cable 7. The position of the deflector 19 is associated with the position of the handle 5. For example, when the handle 5 is positioned at the right maximum steering position, the deflector 19 is positioned at the right maximum steering position. A tilt angle (angle in a plan view) of the jetting direction with respect to the central axis An1 of the nozzle 18 when the deflector 19 is positioned at a maximum steering position is, for example, approximately 30 degrees.

As shown in FIG. 1, the vessel propulsion apparatus 3 further includes the R bucket 24 by which water that flows rearward inside the deflector 19 is guided forward and the F bucket 25 by which the water that flows rearward from the deflector 19 is tilted to the right and left.

As shown in FIG. 1, the R bucket 24 is disposed in front of the F bucket 25. The R bucket 24 is coupled to the deflector 19. The R bucket 24 rotates to the right and left around the axis D1 together with the deflector 19. The R bucket 24 is rotatable up and down with respect to the deflector 19 around a substantially horizontal rotation axis Ad2. The rotation axis Ad2 is an axis that is orthogonal or substantially orthogonal to the central axis Ad1 of the deflector 19 and is fixed with respect to the deflector 19.

Also, as shown in FIG. 1, the F bucket 25 is coupled to the hull 2. The F bucket 25 may be coupled directly to the hull 2 or may be coupled to a member fixed to the hull 2. The F bucket 25 is rotatable up and down with respect to the hull 2 around a substantially horizontal rotation axis An2 that extends in the right/left direction. The nozzle 18 is fixed to the hull 2. The F bucket 25 is thus rotatable up and down with respect to the nozzle 18. The rotation axis An2 is an axis that is fixed with respect to the nozzle 18.

As shown in FIG. 1, the vessel propulsion apparatus 3 includes an R actuator 28 that rotates the R bucket 24 around the rotation axis Ad2 and an R cable 29 that transmits a power of the R actuator 28 to the R bucket 24. Further, the vessel propulsion apparatus 3 includes an F actuator 30 that rotates the F bucket 25 around the rotation axis An2 and an F cable 31 that transmits a power of the F actuator 30 to the F bucket 25. The R actuator 28 may drive the R bucket 24 via a transmission member besides the R cable 29, such as a rod, gear, or a wrapping transmission, for example, or may drive the R bucket 24 directly. That is, the R actuator 28 may be an actuator that is disposed on the rotation axis Ad2 and directly drives the R bucket 24. Likewise, the F actuator 30 may drive the F bucket 25 via a transmission member besides the F bucket 25 or may drive the F bucket 25 directly. The ECU 4 controls the R actuator 28 and the F actuator 30 based on the detection value of the lever position detecting device 8. The R bucket 24 and the F bucket 25 are thus positioned at positions that are in accordance with the position of the lever 6.

As shown in FIG. 3 and FIG. 4, the R bucket 24 is rotatable up and down around the rotation axis Ad2 and between a closed position (position indicated by alternate long and two short dashed lines in FIG. 4) and an opened position (position indicated by solid lines). The closed position is a position at which the R bucket 24 covers the entire F outlet 22 in a rear view, and the opened position is a position at which the R bucket 24 does not cover the F outlet 22 in a rear view. Thus, when the R bucket 24 is positioned at the closed position, the F outlet 22 is closed, and when the R bucket 24 is positioned at the opened position, the F outlet 22 is opened. The R bucket 24 is positioned at any position from the closed position to the opened position by operation of the lever 6. For example, the R bucket 24 is positioned at an intermediate position (see FIG. 11B) between the closed position and the opened position by operation of the lever 6. The intermediate position is a position at which the R bucket 24 covers only a portion of the F outlet 22 in a rear view.

Also, as shown in FIG. 3 and FIG. 4, the F bucket 25 is rotatable up and down around the rotation axis An2 and between a closed position (position indicated by solid lines) and an opened position (position indicated by alternate long and two short dashed lines in FIG. 4). The closed position is a position at which the F bucket 25 covers the entire F outlet 22 in a rear view, and the opened position is a position at which the F bucket 25 does not cover the F outlet 22 in a rear view. The closed position of the F bucket 25 is a position further to the rear than the closed position of the R bucket 24. Thus, even when the F bucket 25 is positioned at the closed position, the F bucket 25 only faces the F outlet 22 across an interval in the front/rear direction and the F outlet 22 is not blocked. The F bucket 25 is positioned at any position from the closed position to the opened position by operation of the lever 6. For example, the F bucket 25 is positioned at an intermediate position (see FIG. 11D) between the closed position and the opened position by operation of the lever 6. The intermediate position is a position at which the F bucket 25 covers only a portion of the F outlet 22 in a rear view.

Figure 5A:
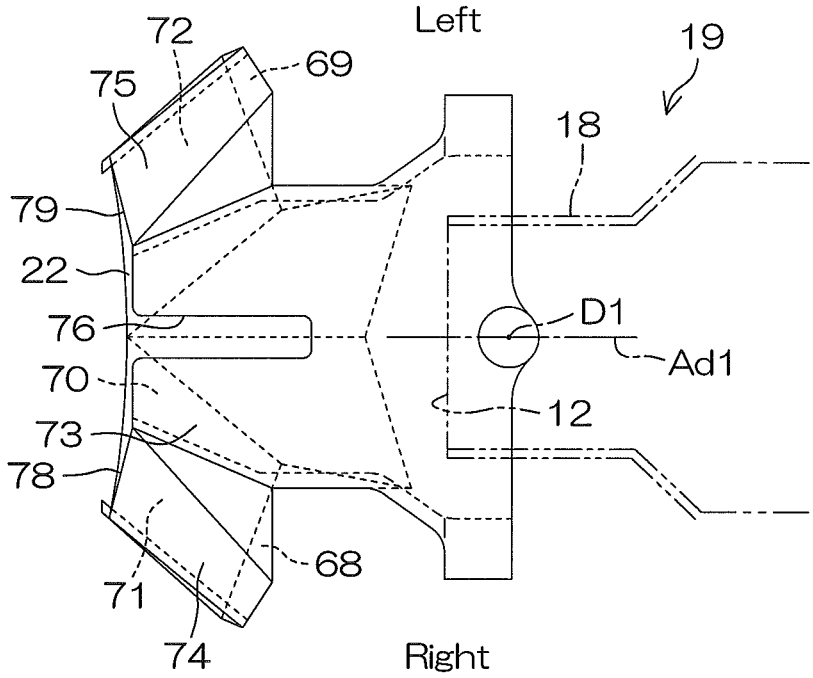
FIG. 5A is schematic plan view of a deflector.
Figure 5B:
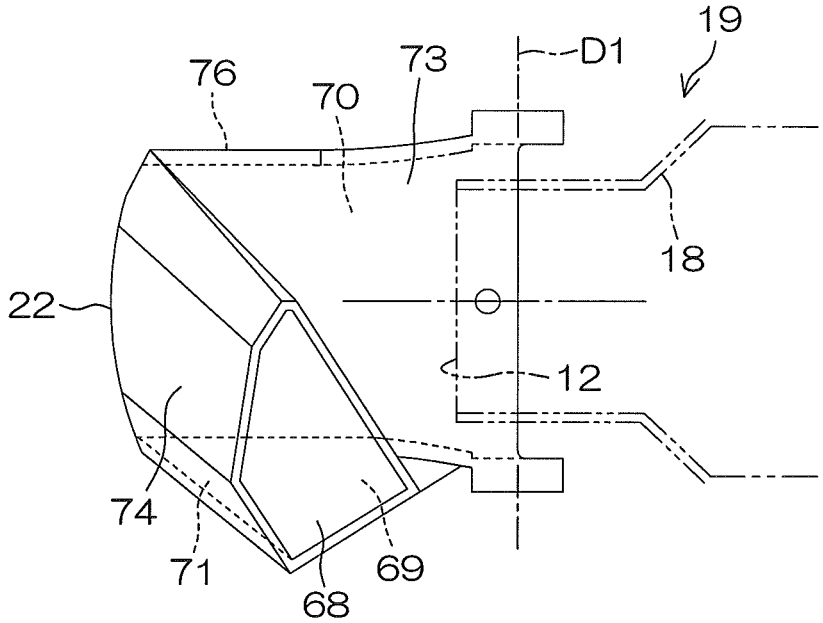
FIG. 5B is a schematic side view of the deflector.
Figure 5C:
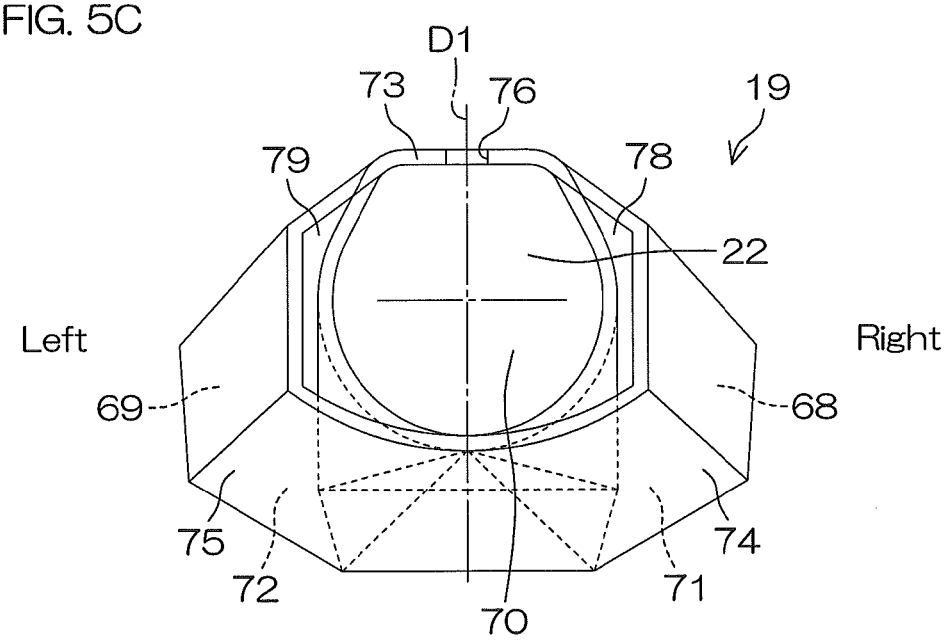
FIG. 5C is a schematic rear view of the deflector.

FIG. 5A is schematic plan view of the deflector 19. FIG. 5B is a schematic side view of the deflector 19. FIG. 5C is a schematic rear view of the deflector 19.

As shown in FIG. 5A, the deflector 19 includes a main flow passage 70 by which water jetted from the nozzle 18 is guided rearward toward the F outlet 22. Further, the deflector 19 includes a right flow passage 71 extending obliquely forward and downward to the right from the main flow passage 70 to the R right outlet 68 and a left flow passage 72 extending obliquely forward and downward to the left from the main flow passage 70 to the R left outlet 69. The deflector 19 includes a central tubular portion 73 extending along the central axis Ad1 of the deflector 19, a right tubular portion 74 disposed at the right side relative to the central tubular portion 73, and a left tubular portion 75 disposed at the left side relative to the central tubular portion 73. The main flow passage, the right flow passage 71, and the left flow passage 72 are defined by the central tubular portion 73, the right tubular portion 74, and the left tubular portion 75, respectively.

As shown in FIG. 5A, the main flow passage 70 is right/left symmetrical. The right flow passage 71 has a shape with which the left flow passage 72 is right/left inverted, and the right flow passage 71 and the left flow passage 72 are respectively disposed right/left symmetrically at the right and left sides of the main flow passage 70. In a plan view, the right flow passage 71 and the left flow passage 72 extend in a V-shape so as to spread forward from a rear end of the main flow passage 70. The right flow passage 71 may be a flow passage that branches from the main flow passage 70 or may be a flow passage that is independent of the main flow passage 70 (a flow passage that is not continuous with the main flow passage 70). The same applies to the left flow passage 72.

As shown in FIG. 5A, the central tubular portion 73 extends rearward from the nozzle 18. The central tubular portion 73 includes an upper wall having a slit 76. The slit 76 extends forward from a rear end of the central tubular portion 73. The slit 76 extends along the central axis Ad1 of the deflector 19 in a plan view. A front end portion of the central tubular portion 73 is coupled to the nozzle 18. The front end portion of the central tubular portion 73 is rotatable to the right and left around the axis D1 with respect to the nozzle 18. The right tubular portion 74 and the left tubular portion 75 rotate to the right and left around the axis D1 together with the central tubular portion 73. The right tubular portion 74 may be a member integral to the central tubular portion 73 or may be a separate member from the central tubular portion 73 that is fixed to the central tubular portion 73. The same applies to the left tubular portion 75.

As shown in FIG. 5A and FIG. 5C, the central tubular portion 73 is right/left symmetrical. The right tubular portion 74 has a shape with which the left tubular portion 75 is right/left inverted and the right tubular portion 74 and the left tubular portion 75 are respectively disposed right/left symmetrically at the right and left sides of the central tubular portion 73. As shown in FIG. 5A, the right tubular portion 74 extends obliquely forward and downward to the right from a right side of a rear end portion of the central tubular portion 73. The front end of the right tubular portion 74 is disposed further to the rear than a front end of the central tubular portion 73. Likewise, the left tubular portion 75 extends obliquely forward and downward to the left from a left side of the rear end portion of the central tubular portion 73. The front end of the left tubular portion 75 is disposed further to the rear than the front end of the central tubular portion 73.

As shown in FIG. 5A, the front end and the rear end of the central tubular portion 73 are open. The outlet 12 of the nozzle 18 is disposed inside the central tubular portion 73. As shown in FIG. 5C, a rear end of the right tubular portion 74 is opened at a right side of the F outlet 22, and a rear end of the left tubular portion 75 is opened at a left side of the F outlet 22. The rear end of the right tubular portion 74 defines a right inlet 78 that is opened rearward at the right side of the F outlet 22, and the rear end of the left tubular portion 75 defines a left inlet 79 that is opened rearward at the left side of the F outlet 1022.

Also, as shown in FIG. 5A, the front end of the right tubular portion 74 is opened at a position further forward than the rear end of the central tubular portion 73, and the front end of the left tubular portion 75 is opened at a position further forward than the rear end of central tubular portion 73. The front end of the right tubular portion 74 defines the R right outlet 68 and the front end of the left tubular portion 75 defines the R left outlet 69. The rear end of the central tubular portion 73 defines the F outlet 22. As shown in FIG. 5B, an upper end of the F outlet 22 is disposed above the R right outlet 68 and the R left outlet 69, and a lower end of the F outlet 22 is disposed at a height between upper ends and lower ends of the R right outlet 68 and the R left outlet 69.

Figure 6A:
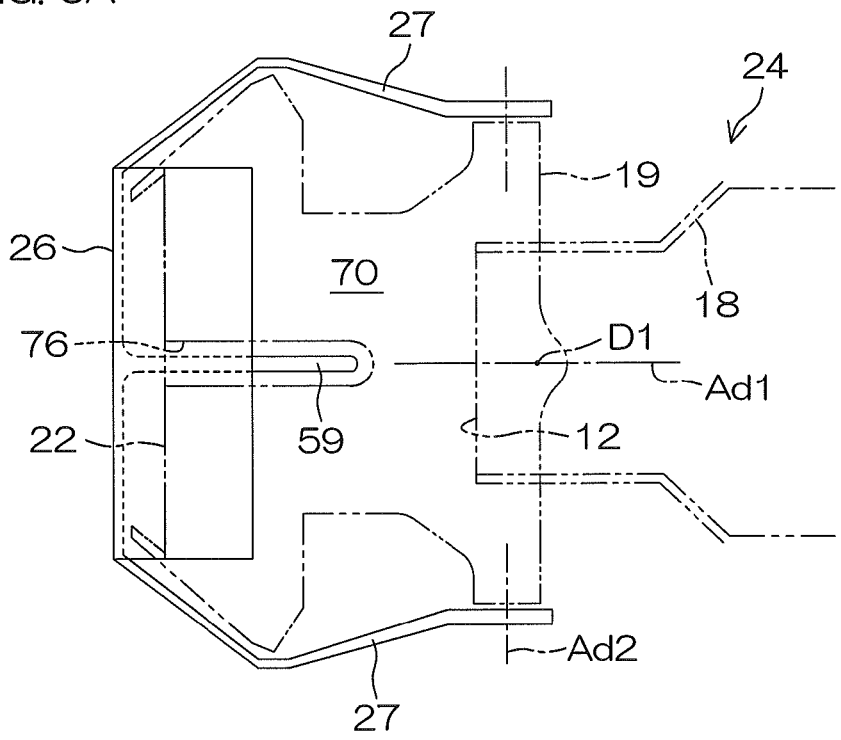
FIG. 6A is a schematic plan view of the R bucket.
Figure 6B:
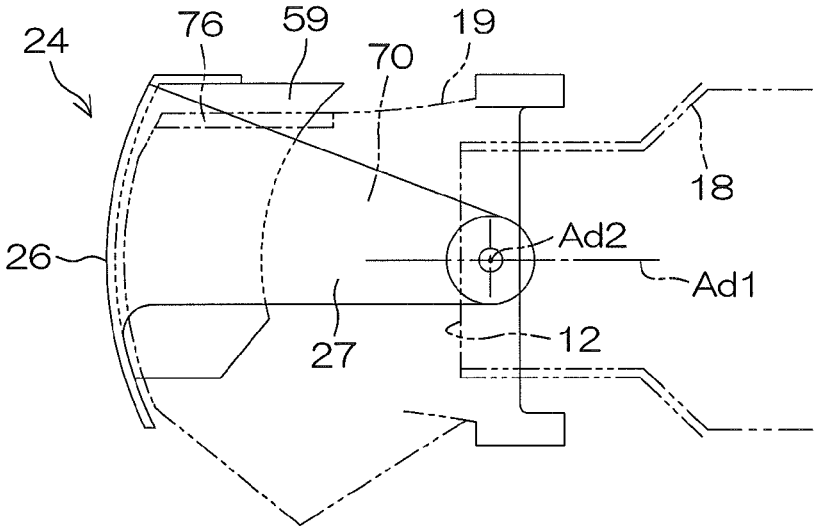
FIG. 6B is a schematic side view of an R bucket.
Figure 6C:
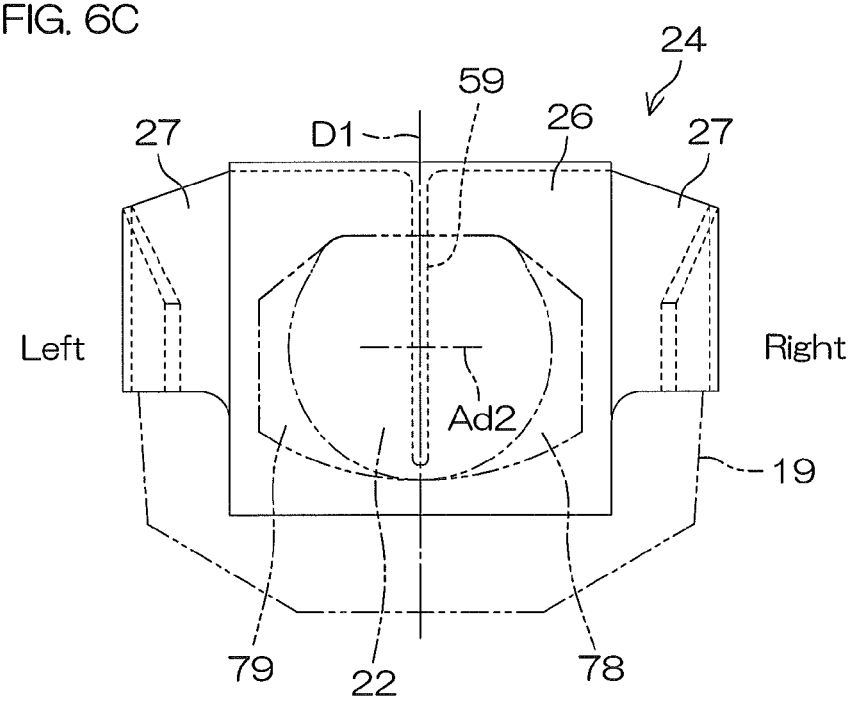
FIG. 6C is a schematic rear view of the R bucket.

FIG. 6A is a schematic plan view of the R bucket 24. FIG. 6B is a schematic side view of the R bucket 24. FIG. 6C is a schematic rear view of the R bucket 24.

The R bucket 24 is disposed in front of the F bucket 25 (see FIG. 1). As shown in FIG. 6A, the R bucket 24 is coupled to the deflector 19. The R bucket 24 rotates right and left around the axis D1 together with the deflector 19. The R bucket 24 is right/left symmetrical. The R bucket 24 includes a lid portion 26 that opens and closes the F outlet 22, a pair of right and left R arms 27 that support the lid portion 26, and a plate-shaped R guide 59 that extends forward from the lid portion 26.

As shown in FIG. 6A, the lid portion 26 is disposed at the rear of the F outlet 22. The pair of R arms 27 are disposed across an interval in the right/left direction. The pair of R arms 27 extend forward from a right end portion and a left end portion of the lid portion 26. A front end portion of each R arm 27 is coupled to the deflector 19. The front end portion of each R arm 27 is rotatable up and down with respect to the deflector 19 around the rotation axis Ad2. The R bucket 24 is thus rotatable up and down with respect to the deflector 19 around the rotation axis Ad2. The rotation axis Ad2 is an axis that is fixed with respect to the deflector 19.

The R bucket 24 is rotatable up and down around the rotation axis Ad2 with respect to the deflector 19 and between a closed position and an opened position. As shown in FIG. 6C, in a state in which the R bucket 24 is positioned at the closed position, the entire F outlet 22 is covered by the lid portion 26. Further, in this state, the entire right inlet 78 and left inlet 79 are also covered by the lid portion 26. On the other hand, in a state in which the R bucket 24 is positioned at the opened position, the entire lid portion 26 is positioned above the F outlet 22, the right inlet 78, and the left inlet 79 (see FIG. 11E). The entire F outlet 22, right inlet 78, and left inlet 79 are thus open.

As shown in FIG. 6A, the R guide 59 is a plate-shaped member that extends forward from the lid portion 26. The R guide 59 is a portion of the R bucket 24. The R guide 59 rotates up and down around the rotation axis Ad2 together with the lid portion 26. The R guide 59 may be integral to the lid portion 26 or may be a separate member from the lid portion 26 that is fixed to the lid portion 26. Also, the R guide 59 does not have to be a portion of the R bucket 24. For example, the R guide 59 may be fixed to the deflector 19 and does not have to rotate up and down together with the lid portion 26 around the rotation axis Ad2.

As shown in FIG. 6A, the R guide 59 extends forward from a width direction center of a front surface of the lid portion 26. In a plan view, the R guide 59 is disposed on the central axis Ad1 of the deflector 19. A front end of the R guide 59 is disposed further to the rear than the axis D1 and the nozzle 18. The R guide 59 extends in the up/down direction. The R guide 59 is thus supported by the lid portion 26 in an upright attitude. The R guide 59 enters into an interior (main flow passage 70) of the central tubular portion 73 through the F outlet 22. Further, the R guide 59 enters into the interior of the central tubular portion 73 through the slit 76. The R guide 59 divides the F outlet 22 and the main flow passage 70 equally or substantially equally to the right and left.

As shown in FIG. 6B, the R guide 59 is movable up and down inside the slit 76. The R guide 59 enters and exits the main flow passage 70 through the slit 76 (see FIG. 11C to FIG. 11E). That is, when the R bucket 24 moves to the opened position side, the R guide 59 moves to the upper side and a volume of a portion (portion of the R guide 59) entering inside the main flow passage 70 decreases. When the R bucket 24 is positioned at the opened position, all or nearly all of the R guide 59 is positioned outside the main flow passage 70.

Figure 7A:
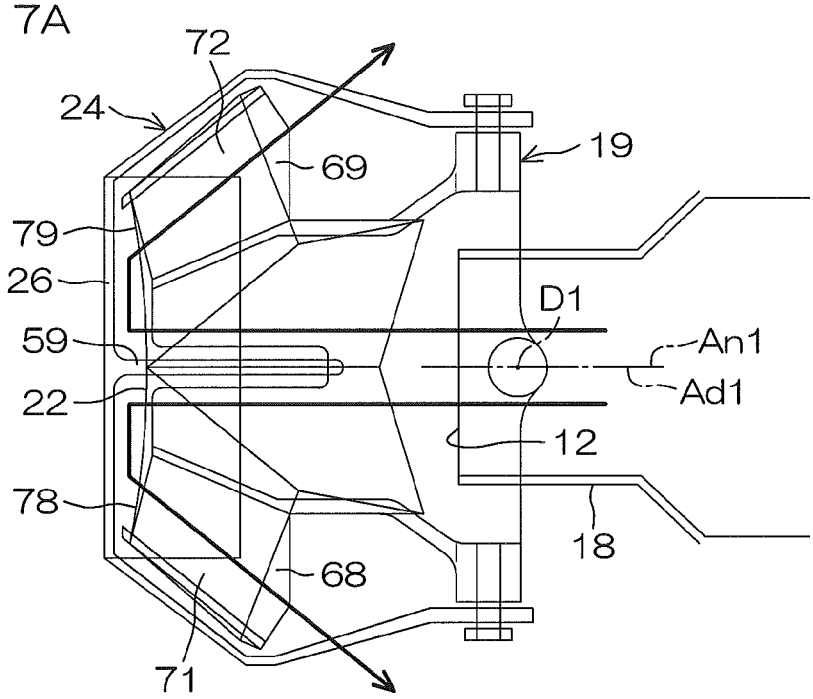
FIG. 7A is a schematic plan view describing water flow in a state in which the R bucket is positioned at a closed position and the deflector is positioned at a straight drive position.
Figure 7B:
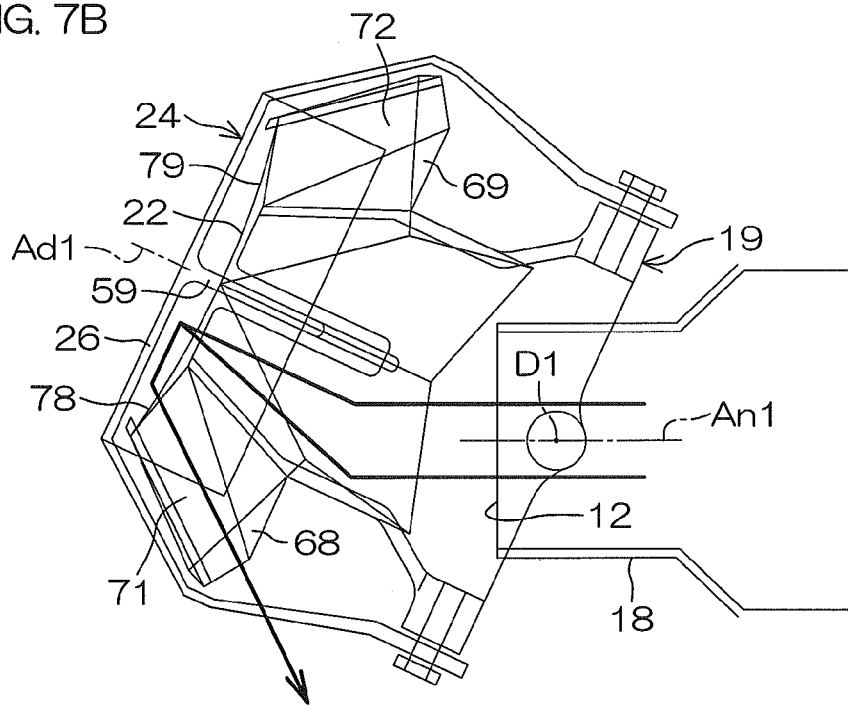
FIG. 7B is a schematic plan view describing water flow in a state in which the R bucket is positioned at the closed position and the deflector is positioned at a left side.

FIG. 7A is a schematic plan view describing water flow in a state in which the R bucket 24 is positioned at the closed position and the deflector 19 is positioned at the straight drive position. FIG. 7B is a schematic plan view for describing water flow in a state in which the R bucket 24 is positioned at the closed position and the deflector 19 is positioned at a left side. In FIG. 7A and FIG. 7B, the vessel propulsion apparatus 3 is shown in a transparent state. Thick line arrows shown in FIG. 7A to FIG. 7B indicate directions of water streams.

As shown in FIG. 7A, in the state in which the R bucket 24 is positioned at the closed position, the entire F outlet 22, right inlet 78, and left inlet 79 are covered by the R bucket 24. Further, in this state, the R guide 59 enters inside the deflector 19 and the interior of the deflector 19 is partitioned to the right and left by the R guide 59. Thus, when water is jetted rearward from the nozzle 18, the water flowing inside the deflector 19 is divided to the right and left at equal or substantially equal flow rates by the R guide 59. Water flowing to the right side of the R guide 59 is jetted rearward from the F outlet 22 and thereafter guided by the lid portion 26 to the right inlet 78. Water thus flows into the right flow passage 71 and water is jetted obliquely forward to the right and downward from the R right outlet 68. Likewise, water flowing to the left side of the R guide 59 flows through the F outlet 22 and into the left flow passage 72 and is jetted obliquely forward to the left and downward from the R left outlet 69.

Thus, in the state in which the R bucket 24 is positioned at the closed position and the deflector 19 is positioned at the straight drive position, the water flowing into the deflector 19 from the nozzle 18 is divided to the right and left at equal or substantially equal flow rates by the R guide 59. A right branch stream flowing in an obliquely forward right direction and a left branch stream flowing in an obliquely forward left direction are thus generated by the R bucket 24. The R guide 59 is disposed, in a plan view, on the central axis Ad1 of the deflector 19. The R guide 59 thus generates the left branch stream from the water stream flowing to the left side relative to the central axis Ad1 of the deflector 19 and generates the right branch stream from the water stream flowing to the right side relative to the central axis Ad1 of the deflector 19. The obliquely forward right direction is a direction with which the obliquely forward left direction is right/left inverted, and in the above state, the right branch stream and the left branch stream have the same or substantially the same flow rate. Thus, in this state, the right direction component and the left direction component of thrust cancel each other out and only the rear direction component remains.

On the other hand, in the state in which the R bucket 24 is positioned at the closed position and the deflector 19 is positioned at the left side, the front end of the R guide 59 is positioned at the left side relative to the central axis An1 of the nozzle 18 as shown in FIG. 7B. Thus, a region of no less than half of the outlet 12 of the nozzle 18 is positioned at the right side relative to the front end of the R guide 59. Thus, when water is jetted rearward from the nozzle 18 in this state, a large portion of the water flowing into the deflector 19 from the nozzle 18 is guided by the R guide 59 to the right side relative to the R guide 59. The water flowing to the right side of the R guide 59 flows through the F outlet 22 and into the right flow passage 71 and is jetted obliquely forward to the right and downward from the R right outlet 68.

Thus, in the state in which the R bucket 24 is positioned at the closed position and the deflector 19 is positioned at the left side, a large portion of the water flowing into the deflector 19 from the nozzle 18 is jetted in the obliquely forward right direction from the R right outlet 68. The right branch stream is thus generated to have a greater flow rate than the left branch stream. A reverse drive direction thrust that turns the hull 2 rightward in a plan view is thus generated. In a state in which the deflector 19 is oppositely positioned at the right side, the left branch stream is caused to have a greater flow rate than the right branch stream. A reverse drive direction thrust that turns the hull 2 leftward in a plan view is thus generated.

With the R bucket 24, water flowing rearward inside the deflector 19 is changed to forward in direction and thereafter jetted in at least one of either of the obliquely forward right direction and the obliquely forward left direction. The obliquely forward right direction and the obliquely forward left direction are directions that are symmetrical or substantially symmetrical with respect to the central axis Ad1 of the deflector 19. The tilt angles of the obliquely forward right direction and the obliquely forward left direction with respect to the central axis An1 of the nozzle 18 change in accordance with the movement of the deflector 19 around the axis D1. However, at any steering position, the tilt angles of the obliquely forward right direction and the obliquely forward left direction are greater than the tilt angle of the central axis Ad1 of the deflector 19 with respect to the central axis An1 of the nozzle 18. A thrust having a greater right/left direction component is thus generated. A large force of turning the vessel 1 in the reverse drive state can thus be generated.

Figure 8A:
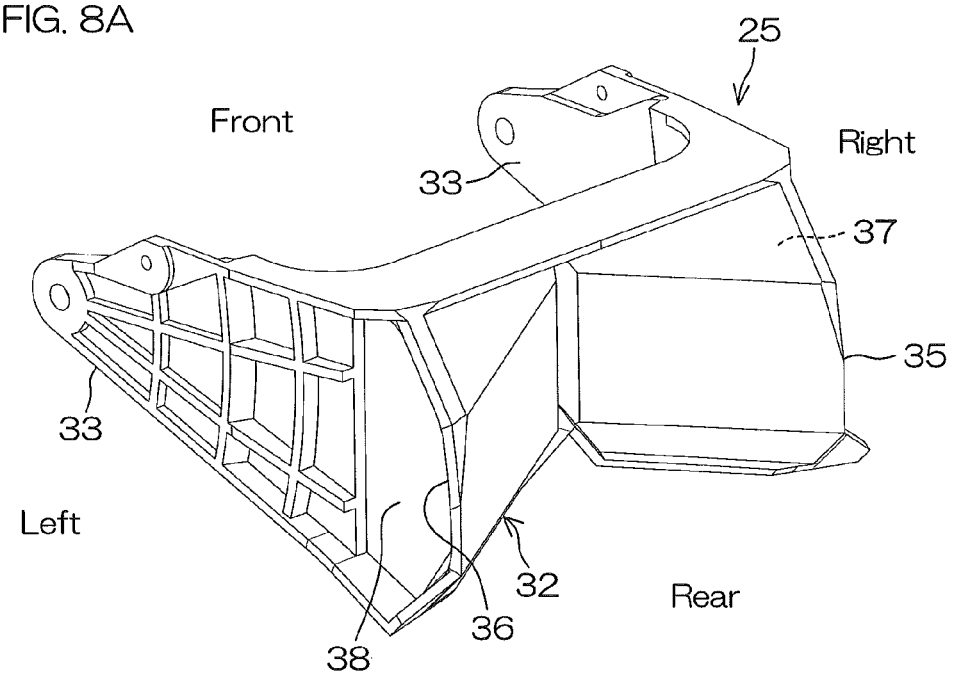
FIG. 8A is a perspective view of the F bucket as viewed from an obliquely rearward left upper side.
Figure 8B:
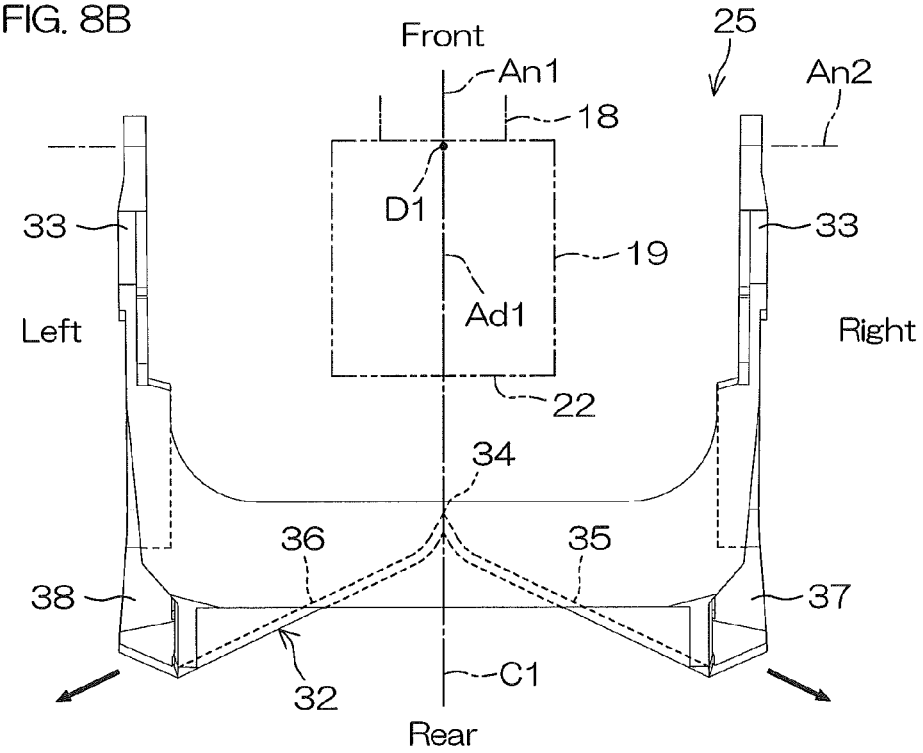
FIG. 8B is a plan view of the F bucket.

FIG. 8A is a perspective view of the F bucket 25 as viewed from an obliquely rearward left upper side. FIG. 8B is a plan view of the F bucket 25.

As shown in FIG. 8B, the F bucket 25 has, in a plan view, a U-shaped configuration that is opened forward. The F bucket 25 is right/left symmetrical. The F bucket 25 surrounds the deflector 19 in a plan view. The F bucket 25 includes an F guide 32 disposed at the rear of the deflector 19 and a pair of right and left F arms 33 that support the F guide 32. The F guide 32 is disposed further to the rear than the closed position of the R bucket 24. The pair of F arms 33 are disposed across an interval in the right/left direction. The deflector 19 is disposed between the pair of F arms 33 in a plan view. The interval between the pair of F arms 33 in the right/left direction is set so that regardless of which steering position the deflector 19 is positioned at, the deflector 19 and the R bucket 24 do not contact the pair of F arms 33 (see FIG. 9B).

As shown in FIG. 8B, the F guide 32 has, in a plan view, a right/left symmetrical V-shaped configuration that is opened rearward. The F guide 32 includes an F apex portion 34 disposed on the central axis Ad1 of the deflector 19 positioned at the straight drive position, an F right guide 35 extending obliquely rearward to the right from the F apex portion 34, and an F left guide 36 extending obliquely rearward to the left from the F apex portion 34. A front end of the F guide 32 (front end of the F apex portion 34) is positioned further to the rear than the axis D1 and the nozzle 18. The F right guide 35 has a shape with which the F left guide 36 is right/left inverted, and the F right guide 35 and the F left guide 36 are disposed right/left symmetrically.

As shown in FIG. 8A, the right side F arm 33 extends forward from a right end portion of the F right guide 35, and the left side F arm 33 extends forward from a left end portion of the F left guide 36. A front end portion of each F arm 33 is coupled to the hull 2. The front end portion of each F arm 33 is rotatable up and down around the rotation axis An2 with respect to the hull 2. As shown in FIG. 8B, the right side F arm 33 and the right end portion of the F right guide 35 define an F right outlet 37 that is opened rightward, and the left side F arm 33 and the left end portion of the F left guide 36 define an F left outlet 38 that is opened leftward.

As shown in FIG. 8B, by the F right guide 35, water jetted rearward from the deflector 19 (F outlet 22) is guided in a right guiding direction (direction of a thick line arrow pointing to the right). The right guiding direction is a direction that is tilted further to the right than the direction of jetting of water from the F outlet 22 at the right maximum steering position. The right guiding direction may be an obliquely rearward right direction or may be the right direction. In FIG. 8B, a case in which the right guiding direction is an obliquely rearward right direction is shown. A water stream guided by the F right guide 35 is jetted in the right guiding direction from the F right outlet 37. That is, the water jetted from the F outlet 22 is jetted in a direction that is tilted further to the right than the direction of jetting of water from the F outlet 22.

Likewise, as shown in FIG. 8B, by the F left guide 36, water jetted rearward from the deflector 19 (F outlet 22) is guided in a left guiding direction (direction of a thick line arrow pointing to the left). The left guiding direction is a direction with which the right guiding direction is right/left inverted. The left guiding direction is a direction that is tilted further to the left than the direction of jetting of water from the F outlet 22 at the left maximum steering position. The left guiding direction may be an obliquely rearward left direction or may be the left direction. In FIG. 8B, a case in which the left guiding direction is an obliquely rearward left direction is shown. A water stream guided by the F left guide 36 is jetted in the left guiding direction from the F left outlet 38. That is, the water jetted from the F outlet 22 is jetted in a direction that is tilted further to the left than the direction of jetting of water from the F outlet 22.

The right guiding direction and the left guiding direction are directions that are further tilted to the right and left than the directions of jetting of water from the F outlet 22 at the maximum steering positions. In a state in which the F bucket 25 is positioned at the closed position or an intermediate position and the deflector 19 is positioned at the right side or the left side relative to the straight drive position, a forward drive direction thrust that turns the hull 2 rightward or leftward is generated. A right/left direction component of this thrust is greater than that in a case where the F bucket 25 is not used and a front/rear direction component of the thrust is less than that in the case where the F bucket 25 is not used.

Figure 9A:
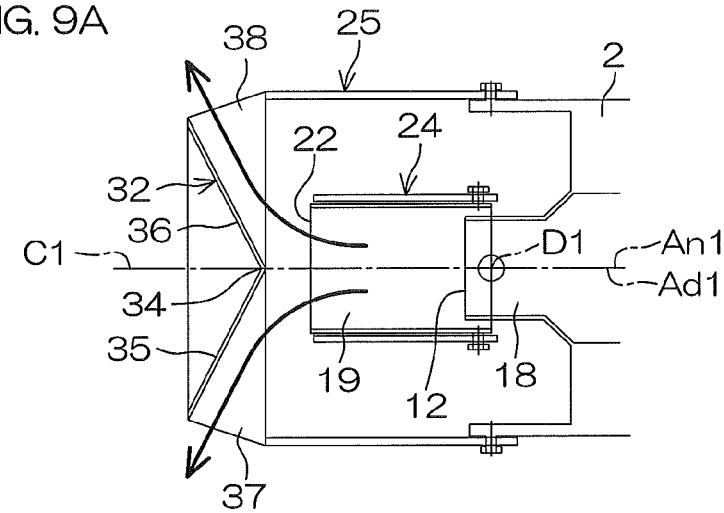
FIG. 9A is a schematic plan view describing water flow in a state in which the F bucket is positioned at a closed position and a deflector is positioned at a straight drive position.
Figure 9B:
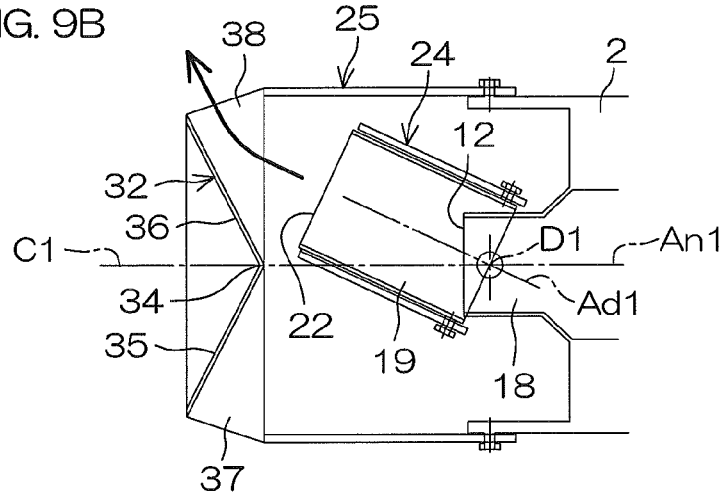
FIG. 9B is a schematic plan view describing water flow in a state in which the F bucket is positioned at the closed position and the deflector is positioned at a left side.
Figure 9C:
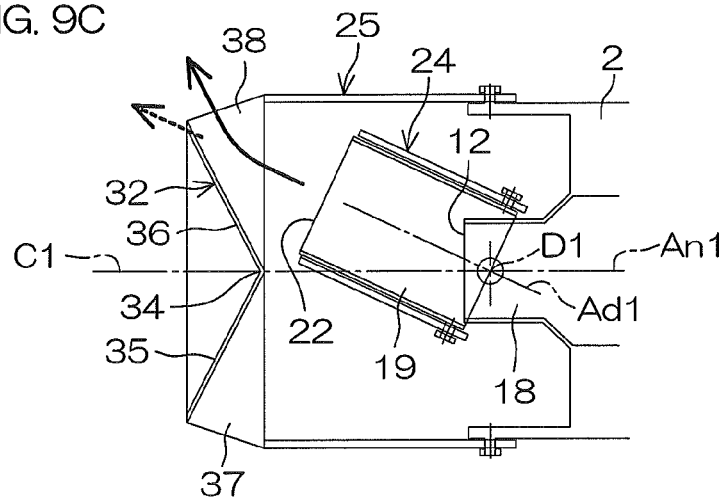
FIG. 9C is a schematic plan view describing water flow in a state in which the F bucket is positioned at an intermediate position and the deflector is positioned at the left side.

FIG. 9A is a schematic plan view describing water flow in a state in which the F bucket 25 is positioned at the closed position and the deflector 19 is positioned at the straight drive position. FIG. 9B is a schematic plan view describing water flow in a state in which the F bucket 25 is positioned at the closed position and the deflector 19 is positioned at the left maximum steering position. FIG. 9C is a schematic plan view describing water flow in a state in which the F bucket 25 is positioned at an intermediate position and the deflector 19 is positioned at the left maximum steering position. In FIG. 9A to FIG. 9C, the vessel propulsion apparatus 3 is shown in a transparent state. Thick line arrows shown in FIG. 9A to FIG. 9C indicate directions of water streams.

As shown in FIG. 9A, in the state in which the F bucket 25 is positioned at the closedposition and the deflector 19 is positioned at the straight drive position, water jetted rearward from the F outlet 22 is divided to the right and left at equal or substantially equal flow rates by the F guide 32. Specifically, water that flows to the right side relative to the F apex portion 34 is guided in the right guiding direction by the F right guide 35 and water that flows to the left side relative to the F apex portion 34 is guided in the left guiding direction by the F left guide 36. A right branch stream flowing in the right guiding direction and a left branch stream flowing in the left guiding direction are thus generated by the F bucket 25. The flow rates of the right branch stream and the left branch stream are the same or substantially the same in this state. The right direction component of thrust and the left direction component of thrust thus cancel each other out and only the front direction component of thrust remains. A forward drive direction thrust that drives the hull 2 straight in the forward direction is thus generated.

On the other hand, when as shown in FIG. 9B, the F bucket 25 is positioned at the closedposition and the deflector 19 is positioned at the left side (left side relative to the straight drive position), the flow rate of water flowing to the left side relative to the F apex portion 34 is greater than the flow rate of water flowing to the right side relative to the F apex portion 34. Thus, in this state, the F guide 32 causes the left branch stream to have a greater flow rate than the right branch stream. Particularly, in a state in which the deflector 19 is positioned at the left maximum steering position (shown in FIG. 9B), all of the water jetted from the F outlet 22 flows to the left side relative to the F apex portion 34. Thus, in this state, only the left branch stream is generated. A forward drive direction thrust that turns the hull 2 leftward is thus generated. In a state in which the deflector 19 is oppositely positioned at the right side (right side relative to the straight drive position), the right branch stream has a greater flow rate than the left branch stream. A forward drive direction thrust that turns the hull 2 rightward is thus generated.

Also, when as shown in FIG. 9C, the F bucket 25 is positioned at the intermediate position, just a portion of the water jetted rearward from the F outlet 22 is guided by the F guide 32 in at least one of either of the right guiding direction and the left guiding direction. The remaining portion passes below the F bucket 25 without being blocked by the F bucket 25 and generates a rearward branch stream that flows in the direction of jetting of water from the F outlet 22 (see FIG. 11D). Thus, in the state in which the F bucket 25 is positioned at the intermediate position, the rearward branch stream is generated in addition to at least one of either of the right branch stream and the left branch stream. A forward drive direction thrust having a larger front direction component than that generated when the F bucket 25 is positioned at the closed position is thus generated.

Figure 10:
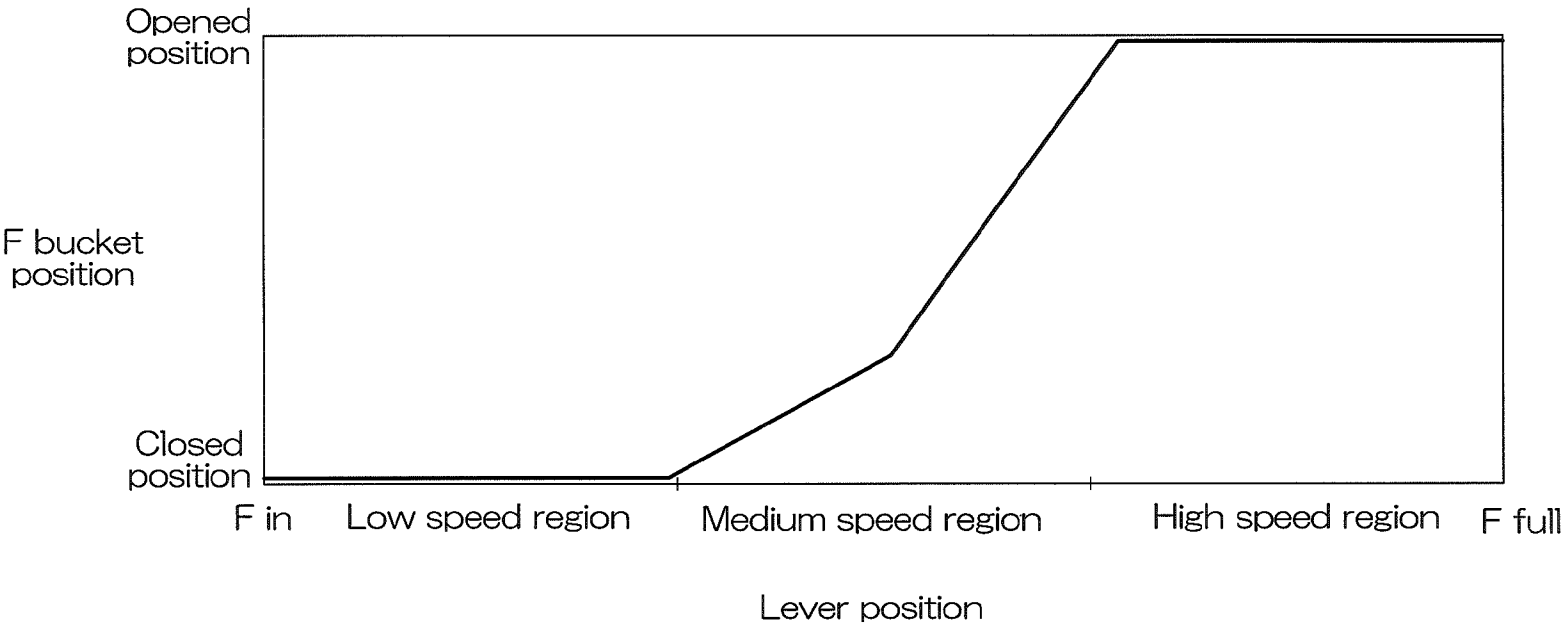
FIG. 10 is a graph of an example of a relationship of a movement amount of a lever from a forward drive shift switching position and a position of the F bucket.

FIG. 10 is a graph of an example of a relationship of the movement amount of the lever 6 from the shift switching position Fin and the position of the F bucket 25.

The ECU 4 controls the F actuator 30, for example, based on the movement amount of the lever 6 from the shift switching position Fin toward the fully opened position Ffull and thereby makes the F bucket 25 rotate up or down around the rotation axis An2.

Specifically, as shown in FIG. 10, in a low speed region (a region inside an F region in which the movement amount of the lever 6 from the shift switching position Fin is small), even when the vessel operator moves the lever 6, the ECU 4 holds the F bucket 25 at the closed position without moving it. In a medium speed region (a region inside the F region in which the movement amount of the lever 6 from the shift switching position Fin is greater than the low speed region), the ECU 4 raises the F bucket 25 in accordance with the movement amount of the lever 6. In the medium speed region, a movement proportion of the F bucket 25 may be fixed or may change as shown in FIG. 10. In a high speed region (region inside the F region in which the movement amount of the lever 6 from the shift switching position Fin is greater than the medium speed region), even when the vessel operator moves the lever 6, the ECU 4 holds the F bucket 25 at the opened position without moving it as in the low speed region.

The ECU 4 is not restricted to controlling the F actuator 30 based on the position of the lever 6 and may perform control based on a parameter related to operation of the engine 10 besides the position of the lever 6. Specifically, the ECU 4 may control the F actuator 30 based on an opening degree of a throttle valve 39 (see FIG. 1) that changes a supply flow rate of intake air. Also, the ECU 4 may control the F actuator 30 based on a detection value of a rotation speed detecting device 40 (see FIG. 1), that is, based on a rotation speed of the engine 10.

The rotation speed of the engine 10 at the shift switching position Fin is, for example, 1300 rpm (idling speed), and the rotation speed of the engine 10 at a boundary position of the low speed region and the medium speed region (low/medium boundary position) is, for example, 2000 rpm. The rotation speed of the engine 10 at a boundary position of the medium speed region and the high speed region (medium/high boundary position) is, for example, 4000 rpm, and the rotation speed of the engine 10 at the fully opened position Ffull is, for example, 7000 rpm. The ECU 4 may thus move the F bucket 25 in accordance with these numerical values.

FIG. 11A to FIG. 11E are schematic side views describing an example of a relationship of the position of the lever 6 and the positions of the R bucket 24 and the F bucket 25. In FIG. 11A to FIG. 11E, the vessel propulsion apparatus 3 is shown in a transparent state. Thick line arrows shown in FIG. 11A to FIG. 11E indicate directions of water streams.

In a state in which the lever 6 is positioned in the R region, the ECU 4 positions both the R bucket 24 and the F bucket 25 at the closed positions as shown in FIG. 11A. When the R bucket 24 is positioned at the closed position, the F outlet 22 of the deflector 19 is closed and thus the water flowing into the deflector 19 from the nozzle 18 is jetted forward and obliquely downward from at least one of either of the R right outlet 68 and the R left outlet 69. A thrust in the reverse drive direction is thereby generated.

As shown in FIG. 11B, in a state in which the lever 6 is positioned in the N region, the ECU 4 positions the R bucket 24 at an intermediate position between the opened position and the closed position and positions the F bucket 25 at the closed position. When the R bucket 24 is positioned at an intermediate position, only a portion of the F outlet 22 is closed. Thus, a portion of the water flowing into the deflector 19 from the nozzle 18 is jetted forward and obliquely downward from at least one of either of the R right outlet 68 and the R left outlet 69. The remaining portion is guided in at least one of either of the right guiding direction and the left guiding direction by the F bucket 25.

In a state in which the R bucket 24 and the F bucket 25 are positioned at an intermediate position and the closed position, respectively, and the deflector 19 is positioned at the straight drive position, a right branch stream and a left branch stream flowing in the obliquely forward right direction and the obliquely forward left direction from the R bucket 24 are generated. The flow rates of the right branch stream and the left branch stream are the same or substantially the same in this state and thus the right direction component of thrust and the left direction component of thrust cancel each other out and only the rear direction component of thrust remains.

Likewise, in the state in which the R bucket 24 and the F bucket 25 are positioned at the intermediate position and the closed position, respectively, and the deflector 19 is positioned at the straight drive position, a right branch stream and a left branch stream flowing in the right guiding direction and the left guiding direction from the F bucket 25 are generated. The flow rates of the right branch stream and the left branch stream are the same or substantially the same in this state, and thus, the right direction component of thrust and the left direction component of thrust cancel each other out and only the front direction component of thrust remains.

The position of the R bucket 24 in the state in which the lever 6 is positioned in the N region is set so that the front direction component of thrust and the rear direction component of thrust cancel each other out when the deflector 19 is positioned at the straight drive position. Thus, in the state in which the R bucket 24 and the F bucket 25 are positioned at the intermediate position and the closed position, respectively, and the deflector 19 is positioned at the straight drive position, no thrust (resultant force) of any direction is generated. On the other hand, in a state in which the deflector 19 is positioned at the right side or the left side, a thrust having a right direction component or a left direction component is generated. Thus, in this state, a force that rotates the hull 2 around a substantially vertical axis passing through the hull 2 is generated and the vessel 1 turns on the spot.

In a state in which the lever 6 is positioned in the low speed region inside the F region, the ECU 4 positions the R bucket 24 at the opened position and positions the F bucket 25 at the closed position as shown in FIG. 11C. When the R bucket 24 is positioned at the opened position, the entire F outlet 22 of the deflector 19 is opened and thus all of the water jetted from the F outlet 22 is guided in at least one of either of the right guiding direction and the left guiding direction by the F bucket 25. A thrust in the forward drive direction is thereby generated.

In a state in which the lever 6 is positioned in the medium speed region inside the F region, the ECU 4 positions the R bucket 24 at the opened position and positions the F bucket 25 at an intermediate position as shown in FIG. 11D. A portion of the water jetted rearward from the deflector 19 is thus guided in at least one of either of the right guiding direction and the left guiding direction by the F bucket 25. The remaining portion passes below the F bucket 25 and flows rearward. A thrust in the forward drive direction having a greater rear direction component than that generated when the lever 6 is positioned in the low speed region is thus generated.

In a state in which the lever 6 is positioned in the high speed region inside the F region, the ECU 4 positions both the R bucket 24 and the F bucket 25 at the opened positions as shown in FIG. 11E. All of the water jetted rearward from the deflector 19 thus passes below the F bucket 25 and flows rearward. A thrust in the forward drive direction having a greater rear direction component than that generated when the lever 6 is positioned in the medium speed region is thus generated.

As described above, with the first preferred embodiment, water jetted rearward from the nozzle 18 passes through the deflector 19 and is jetted rearward from the outlet of the deflector 19. The R bucket 24 is rotatable up and down around the substantially horizontal rotation axis Ad2 and between the closed position of covering at least a portion of the F outlet 22 in a rear view and the opened position of not covering the F outlet 22.

In the state in which the R bucket 24 is positioned at the opened position, the F outlet 22 is not covered and the water jetted from the F outlet 22 flows rearward without being blocked by the R bucket 24. The deflector 19 is rotatable to the right and left around the substantially vertical axis D1 and between the right maximum steering position and the left maximum steering position. The right maximum steering position and the left maximum steering position are positions at which water is jetted from the F outlet 22 in obliquely rearward directions that are tilted to the right and left with respect to the rearward direction. The straight drive position between the right maximum steering position and the left maximum steering position is a position at which water is jetted in the rearward direction from the F outlet 22. The direction of jetting of water from the F outlet 22 changes in accordance with the movement of the deflector 19 around the axis D1. A water stream that flows rearward from the nozzle 18 is thus tilted to the right or left by the deflector 19.

On the other hand, in the state in which the R bucket 24 is positioned at the closed position and the deflector 19 is positioned at the right side relative to the straight drive position, the water jetted obliquely rearward to the right from the F outlet 22 is guided in the obliquely forward left direction by the R bucket 24. The left branch stream flowing in the obliquely forward left direction is thereby generated and the vessel 1 is propelled obliquely rearward to the right. Also, in the state in which the R bucket 24 is positioned at the closed position and the deflector 19 is positioned at the left side relative to the straight drive position, the water jetted obliquely rearward to the left from the F outlet 22 is guided in the obliquely forward right direction by the R bucket 24. The right branch stream flowing in the obliquely forward right direction is thereby generated and the vessel 1 is propelled obliquely rearward to the left.

The water stream guided obliquely rearward to the right by the deflector 19 is thus guided in the obliquely forward left direction by the R bucket 24 and the water stream guided obliquely rearward to the left by the deflector 19 is guided in the obliquely forward right direction by the R bucket 24. A relationship of a steering direction of the handle 5 and a turning direction of the vessel 1 thus does not differ between forward drive and reverse drive. Further, the obliquely forward right direction and the obliquely forward left direction are directions that are tilted more to the right and to the left than the tilt angle of the central axis Ad1 of the deflector 19 with respect to the central axis An1 of the nozzle 18 at the maximum steering positions. The vessel propulsion apparatus 3 can thus tilt the water stream further outward than the maximum rotation angle of the deflector 19. The vessel propulsion apparatus 3 can thus make the vessel 1 turn rapidly during reverse drive.

Second Preferred Embodiment

A second preferred embodiment of the present invention shall now be described. In FIG. 12A to FIG. 14D described below, component portions equivalent to respective portions shown in FIG. 1 to FIG. 11E are provided with the same reference symbols as in FIG. 1 to FIG. 11E, and description thereof shall be omitted.

Figure 12A:
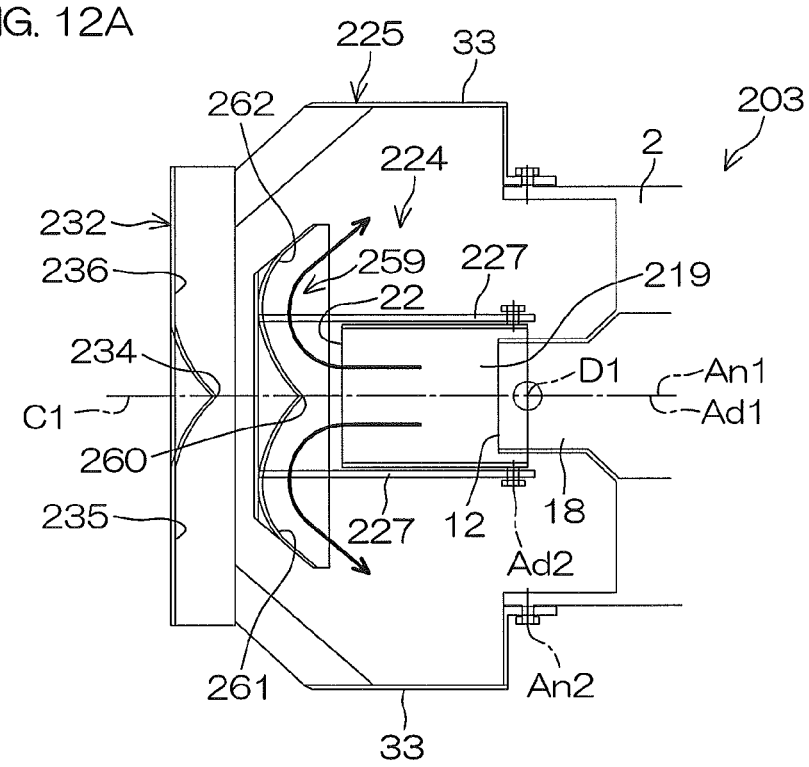
FIG. 12A is a schematic plan view of a vessel propulsion apparatus according to a second preferred embodiment of the present invention.
Figure 12B:
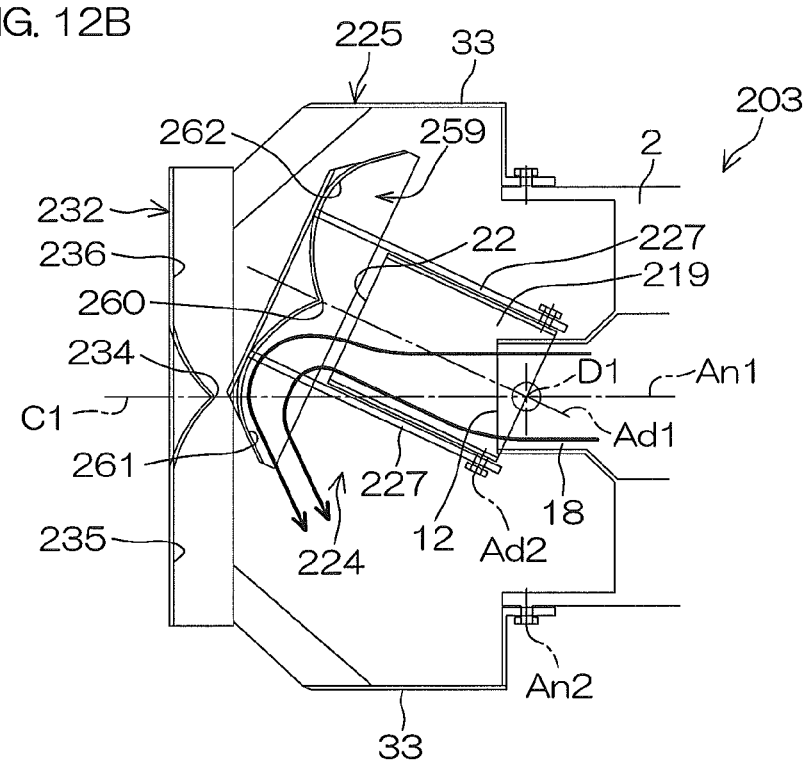
FIG. 12B is a schematic plan view describing water flow in a state in which an R bucket is positioned at a closed position and a deflector is positioned at a left side.

FIG. 12A is a schematic plan view describing water flow in a state in which an R bucket 224 is positioned at a closed position and a deflector 219 is positioned at a straight drive position. FIG. 12B is a schematic plan view describing water flow in a state in which the R bucket 224 is positioned at the closed position and the deflector 219 is positioned at a left side. In FIG. 12A and FIG. 12B, a vessel propulsion apparatus 203 is shown in a transparent state. Thick line arrows shown in FIG. 12A and FIG. 12B indicate directions of water streams.

With the exception of the deflector, the R bucket, and the F bucket, the vessel propulsion apparatus 203 according to the second preferred embodiment preferably has the same or substantially the same arrangement as the vessel propulsion apparatus 3 according to the first preferred embodiment. That is, the vessel propulsion apparatus 203 includes the deflector 219, the R bucket 224, and an F bucket 225 in place of the deflector 19, the R bucket 24, and the F bucket 25 according to the first preferred embodiment. The deflector 219 differs from the deflector 19 according to the first preferred embodiment in that it is not provided with the R right outlet 68 and the R left outlet 69 according to the first preferred embodiment.

The R bucket 224 is coupled to the deflector 219. The R bucket 224 is disposed in front of the F bucket 225. The R bucket 224 rotates to the right or left around the axis D1 together with the deflector 219. The R bucket 224 is rotatable up and down around the rotation axis Ad2 with respect to the deflector 219. The R bucket 224 is rotatable up and down around the rotation axis Ad2 and between the closed position and an opened position.

The R bucket 224 includes an R guide 259 disposed at the rear of the deflector 219 and a pair of right and left R arms 27 that support the R guide 259. The R guide 259 is disposed at the rear of the F outlet 22. The closed position of the R bucket 224 is a position at which the R guide 259 faces the F outlet 22 across an interval in the front/rear direction. The pair of R arms 27 are disposed across an interval in the right/left direction. The deflector 219 is disposed between the pair of R arms 27 in a plan view.

The R guide 259 has a W-shaped configuration that is right/left symmetrical and is opened forward in a plan view. The R guide 259 includes an R apex portion 260 disposed on the central axis Ad1 of the deflector 219. Further, the R guide 259 has a U-shaped R right guide 261 that extends obliquely rearward to the right from the R apex portion 260 and then changes in direction to obliquely forward to the right, and a U-shaped R left guide 262 that extends obliquely rearward to the left from the R apex portion 260 and then changes in direction to obliquely forward to the left. The R right guide 261 has a shape with which the R left guide 262 is right/left inverted, and the R right guide 261 and the R left guide 262 are disposed right/left symmetrically.

As shown in FIG. 12A, when the R bucket 224 is positioned at the closedposition and the deflector 219 is positioned at the straight drive position, the water jetted rearward from the F outlet 22 is divided to the right and left at equal or substantially equal flow rates by the R guide 259. Specifically, water that flows to the right side relative to the R apex portion 260 is guided in an obliquely forward right direction by the R right guide 261 and water that flows to the left side relative to the R apex portion 260 is guided in an obliquely forward left direction by the R left guide 262. A right branch stream flowing in the obliquely forward right direction and a left branch stream flowing in the obliquely forward left direction are thus generated by the R bucket 224. The obliquely forward right direction and the obliquely forward left direction are symmetrical or substantially symmetrical directions with respect to the central axis Ad1 of the deflector 219. Further, in this state, the flow rates of the right branch stream and the left branch stream are the same or substantially the same. The right direction component of thrust and the left direction component of thrust thus cancel each other out and only the rear direction component of thrust remains. A reverse drive direction thrust that drives the hull 2 straight in the rearward direction is thus generated.

Also, when the R bucket 224 is positioned at the closed position and the deflector 219 is positioned at the left side as shown in FIG. 12B, the flow rate of water flowing to the right side relative to the R apex portion 260 is greater than the flow rate of water flowing to the left side relative to the R apex portion 260. The R guide 259 thus causes the right branch stream to have a greater flow rate than the left branch stream. A reverse drive direction thrust that turns the hull 2 rightward is thus generated. In a state in which the deflector 219 is oppositely positioned at the right side, the left branch stream is caused to have a greater flow rate than the right branch stream. A reverse drive direction thrust that turns the hull 2 leftward is thus generated.

The water jetted rearward from the deflector 219 is thus changed to the forward direction and jetted in at least one of either of the obliquely forward right direction and the obliquely forward left direction by the R bucket 224. Tilt angles of the obliquely forward right direction and the obliquely forward left direction with respect to the central axis An1 of the nozzle 18 change in accordance with the movement of the deflector 219 around the axes D1. However, at any steering position, the tilt angles of the obliquely forward right direction and the obliquely forward left direction are greater than the tilt angle of the central axis Ad1 of the deflector 219 with respect to the central axis An1 of the nozzle 18. A thrust having a greater right/left direction component is thus generated. A large force that turns the vessel 1 in the reverse drive state can thus be generated.

Figure 13A:
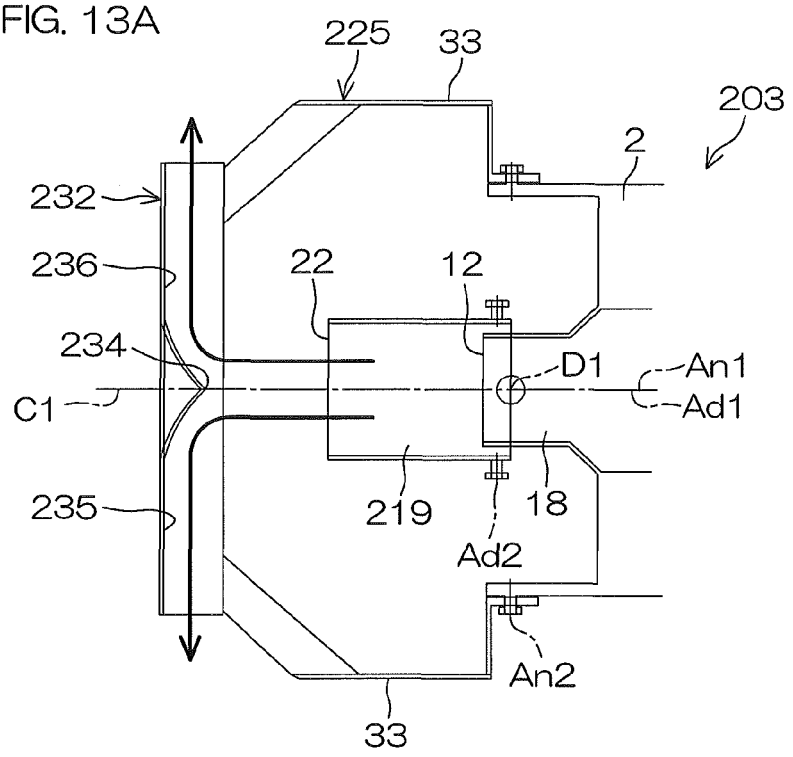
FIG. 13A is a schematic plan view describing water flow in a state in which the F bucket is positioned at the closed position and the deflector is positioned at a straight drive position.
Figure 13B:
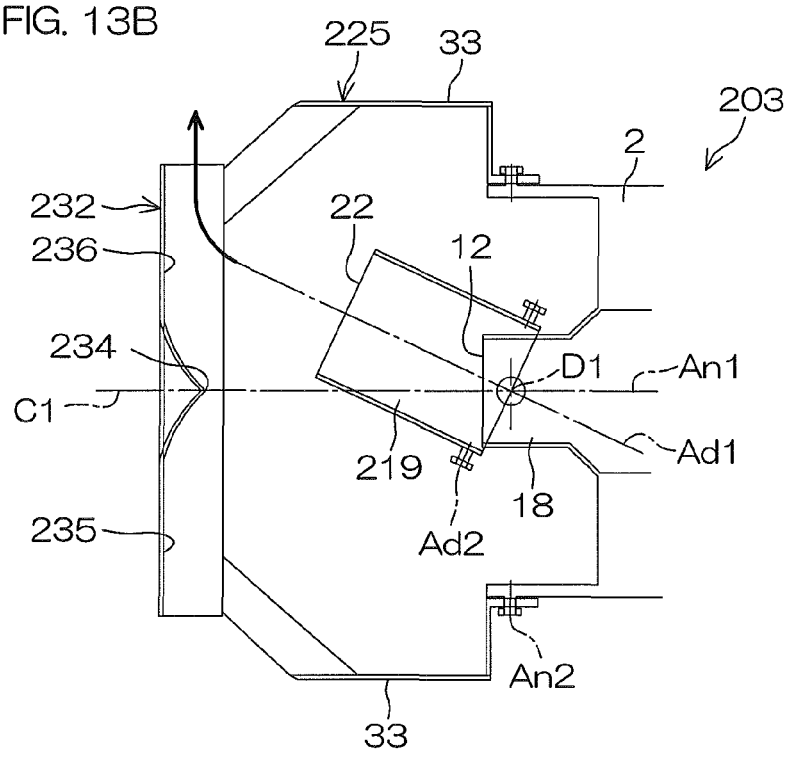
FIG. 13B is a schematic plan view describing water flow in a state in which the F bucket is positioned at the closed position and the deflector is positioned at the left side.

FIG. 13A is a schematic plan view describing water flow in a state in which the F bucket 225 is positioned at the closed position and the deflector 219 is positioned at the straight drive position. FIG. 13B is a schematic plan view describing water flow in a state in which the F bucket 225 is positioned at the closed position and the deflector 219 is positioned at the left side. In FIG. 13A and FIG. 13B, the vessel propulsion apparatus 203 is shown in a transparent state. Thick line arrows shown in FIG. 13A and FIG. 13B indicate directions of water streams.

The F bucket 225 is coupled to the hull 2. The F bucket 225 is rotatable up and down around the rotation axis An2 with respect to the hull 2. The F bucket 225 is rotatable up and down around the rotation axis An2 and between a closed position and an opened position.

The F bucket 225 has a U-shaped configuration that is opened forward in a plan view. The F bucket 225 is right/left symmetrical. The F bucket 225 surrounds the deflector 219 and the R bucket 224 in a plan view (see FIG. 12A). The F bucket 225 includes an F guide 232 disposed at the rear of the deflector 219 and the pair of right and left F arms 33 that support the F guide 232. The F guide 232 is disposed further to the rear than the closed position of the R bucket 224. The pair of F arms 33 are disposed across an interval in the right/left direction. The deflector 219 and the R bucket 224 are disposed between the pair of F arms 33 in a plan view. The interval between the pair of F arms 33 in the right/left direction is set so that regardless of at which steering position the deflector 219 is positioned, the deflector 219 and the R bucket 224 do not contact the pair of F arms 33 (see FIG. 12B).

The F guide 232 has a right/left symmetrical V-shaped configuration that is opened rearward in a plan view. The F guide 232 includes an F apex portion 234 disposed on the central axis Ad1 of the deflector 219 positioned at the straight drive position, an F right guide 235 extending obliquely rearward to the right from the F apex portion 234, and an F left guide 236 extending obliquely rearward to the left from the F apex portion 234. The F right guide 235 has a shape with which the F left guide 236 is right/left inverted, and the F right guide 235 and the F left guide 236 are disposed right/left symmetrically. The right side F arm 33 extends forward from the F right guide 235, and the left side F arm 33 extends forward from the F left guide 236. The front end portion of each F arm 33 is coupled to the hull 2. The front end portion of each F arm 33 is rotatable up and down around the rotation axis An2 with respect to the hull 2.

Water jetted rearward from the deflector 219 is guided in a right guiding direction by the F right guide 235. The water guided by the F right guide 235 is jetted in the right guiding direction from the F bucket 225. Likewise, water jetted rearward from the deflector 219 is guided in a left guiding direction by the F left guide 236. Water guided by the F left guide 236 is jetted in the left guiding direction from the F bucket 225. In FIG. 13A, a case in which the right guiding direction is the right direction and the left guiding direction is the left direction is shown. The water jetted rearward from the deflector 219 is thus guided by the F bucket 225 and jetted directly laterally from the F bucket 225.

As shown in FIG. 13A, in the state in which the F bucket 225 is positioned at the closed position and the deflector 219 is positioned at the straight drive position, the water jetted rearward from the F outlet 22 is divided to the right and left at equal or substantially equal flow rates by the F guide 232. Specifically, water that flows to the right side relative to the F apex portion 234 is guided in the right guiding direction by the F right guide 235 and water that flows to the left side relative to the F apex portion 234 is guided in the left guiding direction by the F left guide 236. A right branch stream flowing in the right guiding direction and a left branch stream flowing in the left guiding direction are thus generated by the F bucket 225. The flow rates of the right branch stream and the left branch stream are the same or substantially the same in this state. The right direction component of thrust and the left direction component of thrust thus cancel each other out. Thus, in this state, no thrust (resultant force) of any direction is generated.

Also, when the F bucket 225 is positioned at the closed position and the deflector 219 is positioned at the left side as shown in FIG. 13B, the flow rate of water flowing to the left side relative to the F apex portion 234 is greater than the flow rate of water flowing to the right side relative to the F apex portion 234. The F guide 232 thus causes the left branch stream to have a greater flow rate than the right branch stream. Particularly, in a state in which the deflector 219 is positioned at the left maximum steering position (shown in FIG. 13B), all of the water jetted from the F outlet 22 flows to the left side relative to the F apex portion 234. Thus, in this state, only the left branch stream is generated. In a state in which the deflector 219 is oppositely positioned at the right side, the right branch stream is caused to have a greater flow rate than the left branch stream. A thrust that turns the hull 2 rightward is thus generated and the vessel 1 turns rightward on the spot.

Also, when the F bucket 225 is positioned at an intermediate position between the closed position and the opened position (see FIG. 14C), just a portion of the water jetted rearward from the F outlet 22 is guided by the F guide 232 in at least one of either of the right guiding direction and the left guiding direction. The remaining portion passes below the F bucket 225 without being blocked by the F bucket 225 and generates a rearward branch stream that flows in the direction of jetting of water from the F outlet 22. Thus, when water is jetted rearward from the F outlet 22 in the state in which the F bucket 225 is positioned at an intermediate position, the rearward branch stream is generated in addition to at least one of either of the right branch stream and the left branch stream.

FIG. 14A to FIG. 14D are schematic side views describing an example of a relationship of the position of the lever 6 and the positions of the R bucket 224 and the F bucket 225. In FIG. 14A to FIG. 14D, the vessel propulsion apparatus 203 is shown in a transparent state. Thick line arrows shown in FIG. 14A to FIG. 14D indicate directions of water streams.

In the state in which the lever 6 (see FIG. 1) is positioned in the R region, the ECU 4 (see FIG. 1) positions both the R bucket 224 and the F bucket 225 at the closed positions as shown in FIG. 14A. When the R bucket 224 is positioned at the closed position, the R guide 259 is positioned at the rear of the F outlet 22 and thus all of the water jetted from the F outlet 22 is guided by the R bucket 224 in at least one of either of an obliquely forward right direction and an obliquely forward left direction. A thrust in the reverse drive direction is thus generated.

As shown in FIG. 14B, in a state in which the lever 6 is positioned in the N region, the ECU 4 positions the R bucket 224 at the opened position and positions the F bucket 225 at the closedposition. When the F bucket 225 is positioned at the closed position, the F guide 232 is positioned at the rear of the F outlet 22 and thus all of the water jetted from the F outlet 22 is guided by the F bucket 225 in at least one of either of the right guiding direction and the left guiding direction.

As shown in FIG. 14C, in a state in which the lever 6 is positioned in the low speed region (position inside the F region), the ECU 4 positions the R bucket 224 at the opened position and positions the F bucket 225 at an intermediate position. In the state in which the F bucket 225 is positioned at the intermediate position, only a portion of the water jetted rearward from the F outlet 22 is guided by the F guide 232 in at least one of either of the right guiding direction and the left guiding direction. The remaining portion passes below the F bucket 225 without being blocked by the F bucket 225 and generates the rearward branch stream that flows in the direction of jetting of water from the F outlet 22.

In a state in which the lever 6 is positioned in the high speed region (in the second preferred embodiment, a position inside the F region at which the movement amount of the lever 6 is greater than that in the low speed region), the ECU 4 positions both the R bucket 224 and the F bucket 225 at the opened positions as shown in FIG. 14D. All of the water jetted rearward from the deflector 219 thus passes below the F bucket 225 and flows rearward. A thrust in the forward drive direction having a greater rear direction component than that generated when the lever 6 is positioned in the low speed region is thus generated.

Third Preferred Embodiment

A third preferred embodiment of the present invention shall now be described. In FIG. 15 to FIG. 19D below, component portions equivalent to respective portions shown in FIG. 1 to FIG. 14E are provided with the same reference symbols as in FIG. 1 to FIG. 14E, and description thereof shall be omitted.

Figure 15:
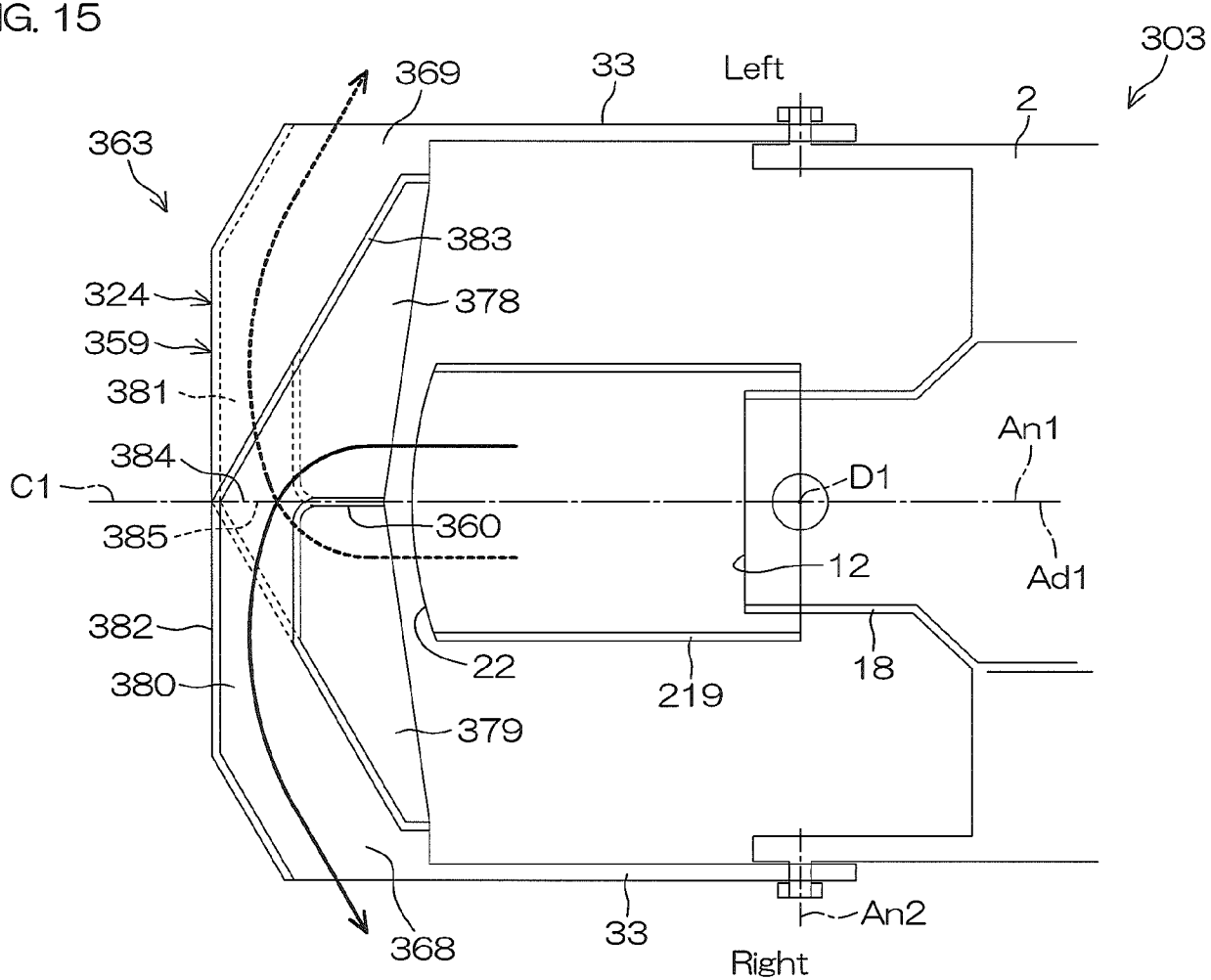
FIG. 15 is a schematic plan view of a vessel propulsion apparatus according to a third preferred embodiment of the present invention.
Figure 16A:
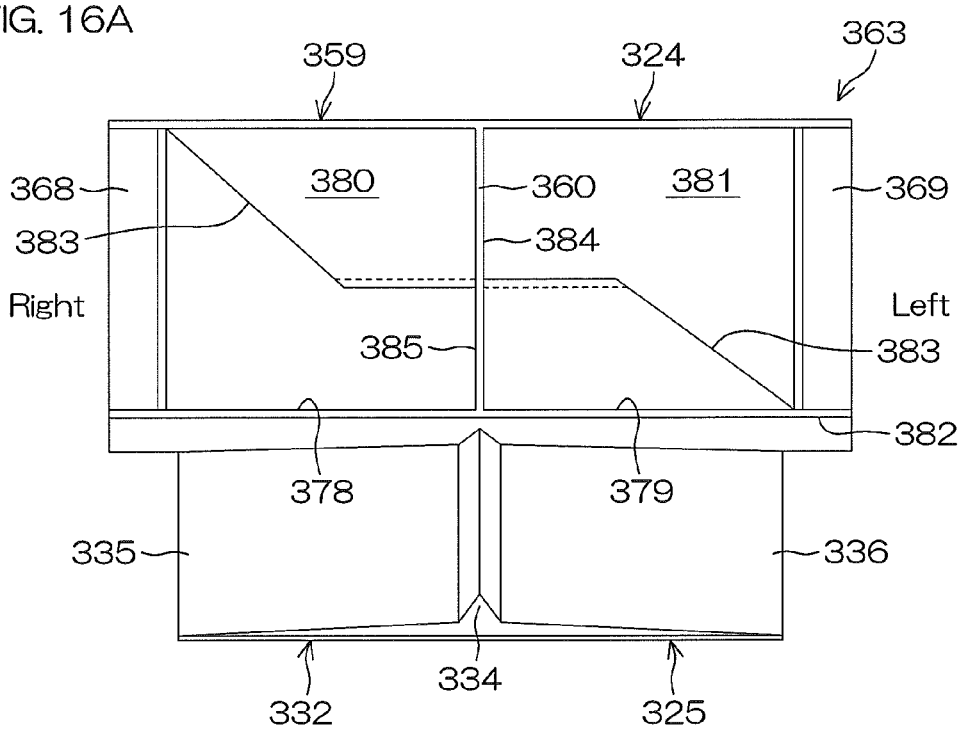
FIG. 16A is a schematic front view of a bucket.
Figure 16B:
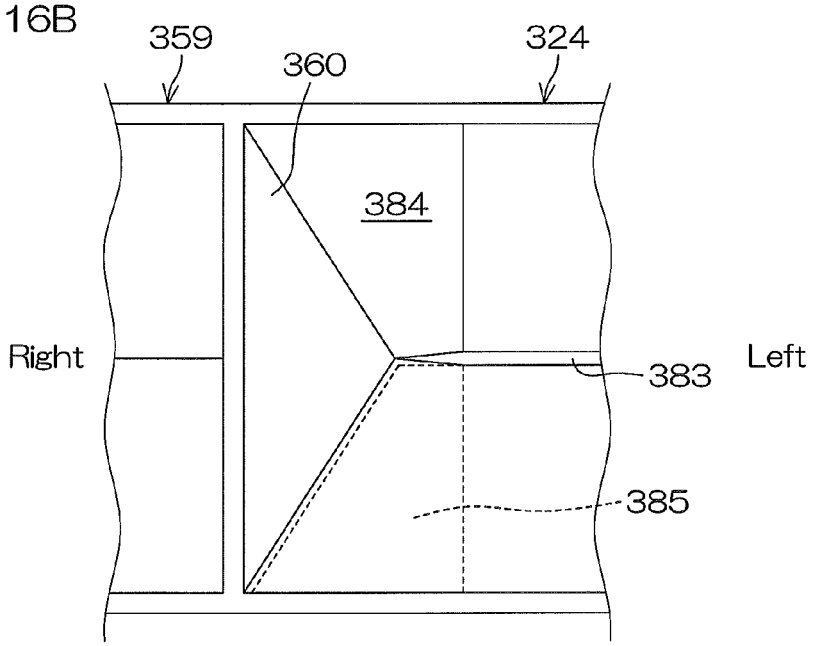
FIG. 16B is a schematic perspective view of a central portion of an R bucket.

FIG. 15 is a schematic plan view of a vessel propulsion apparatus 303 according to the third preferred embodiment of the present invention. FIG. 16A is a schematic front view of a bucket 363. FIG. 16B is a schematic perspective view of a central portion of an R bucket 324.

With the exception of the deflector, the R bucket, and the F bucket, the vessel propulsion apparatus 303 according to the third preferred embodiment preferably has the same or substantially the same arrangement as the vessel propulsion apparatus 3 according to the first preferred embodiment. That is, as shown in FIG. 16A, the vessel propulsion apparatus 303 includes a bucket 363 in place of the R bucket 24 and the F bucket 25 according to the first preferred embodiment. Further, the vessel propulsion apparatus 303 includes the deflector 219 according to the second preferred embodiment in place of the deflector 19 according to the first preferred embodiment.

As shown in FIG. 15, the bucket 363 is coupled to the hull 2. The bucket 363 is rotatable up and down around the rotation axis An2 with respect to the hull 2. The bucket 363 is rotatable up and down around the rotation axis An2 and between a closed position at which the bucket 363 covers the entire F outlet 22 in a rear view and an opened position at which the bucket 363 does not cover the F outlet 22 in a rear view. The bucket 363 is coupled to the F cable 31 (see FIG. 1). The ECU 4 (see FIG. 1) controls the F actuator 30 (see FIG. 1) coupled to the F cable 31 to rotate the bucket 363 up and down around the rotation axis An2.

As shown in FIG. 16A, the bucket 363 includes the R bucket 324 by which water flowing rearward from the deflector 219 is guided forward and an F bucket 325 by which a water stream flowing rearward from the deflector 219 is tilted to the right and left. The R bucket 324 is disposed above the F bucket 325. The R bucket 324 rotates up and down around the rotation axis An2 together with the F bucket 325. The F bucket 325 may be integral to the R bucket 324 or may be a separate member from the R bucket 324 that is fixed to the R bucket 324.

As shown in FIG. 15, the bucket 363 further includes the pair of right and left F arms 33 that support the R bucket 324 and the F bucket 325. The pair of F arms 33 are disposed across an interval in the right/left direction. The pair of F arms 33 extend from a right end portion and a left end portion of the R bucket 324. A front end portion of each F arm 33 is coupled to the hull 2. The front end portion of each F arm 33 is rotatable up and down around the rotation axis An2 with respect to the hull 2. The deflector 219 is disposed between the pair of F arms 33 in a plan view. The interval between the pair of F arms 33 in the right/left direction is set so that regardless of at which steering position the deflector 219 is positioned, the deflector 219 does not contact the pair of F arms 33.

As shown in FIG. 15, the R bucket 324 includes an R guide 359 by which water jetted rearward from the deflector 219 is guided in at least one of either of an obliquely forward right direction or an obliquely forward left direction. The R guide 359 is disposed further to the rear than the axis D1 and the nozzle 18. The R guide 359 is right/left asymmetrical. The R guide 359 includes a right inlet 379 and a left inlet 378 into which water flows and an R right outlet 368 and an R left outlet 369 that jet water. Further, the R guide 359 includes a right flow passage 380 connecting the left inlet 378 and the R right outlet 368 and a left flow passage 381 connecting the right inlet 379 and the R left outlet 369. As shown in FIG. 16A, the R guide 359 further includes a housing 382 having a C-shaped vertical section that is opened forward, a partitioning plate 383 partitioning an interior of the housing 382, and an R separating portion 360 partitioning the interior of the housing 382 right and left at an equal interval.

As shown in FIG. 16B, the R separating portion 360 is a plate-shaped member that is arranged in an upright attitude. As shown in FIG. 15, the R separating portion 360 is disposed on the central axis Ad1 of the deflector 219 positioned at the straight drive position. The left inlet 378 is disposed at the left side of the R separating portion 360, and the right inlet 379 is disposed at the right side of the R separating portion 360. The left inlet 378 and the right inlet 379 are opened forward. The R right outlet 368 is opened obliquely forward to the right at a right end portion of the housing 382, and the R left outlet 369 is opened obliquely forward to the left at a left end portion of the housing 382. The right flow passage 380 extends from the left inlet 378 to the R right outlet 368, and the left flow passage 381 extends from the right inlet 379 to the R left outlet 369. The right flow passage 380 thus extends from a left side of the R separating portion 360 to a right side of the R separating portion 360, and the left flow passage 381 extends from the right side of the R separating portion 360 to the left side of the R separating portion 360.

As shown in FIG. 16B, the right flow passage 380 includes an upper intermediate opening 384 that is opened leftward at the rear of the R separating portion 360. Likewise, the left flow passage 381 includes a lower intermediate opening 385 that is opened rightward at the rear of the R separating portion 360. The upper intermediate opening 384 and the lower intermediate opening 385 are aligned vertically. The right flow passage 380 and the left flow passage 381 thus cross vertically. The right flow passage 380 and the left flow passage 381 are mutually independent and are not connected. That is, the right flow passage 380 and the left flow passage 381 are partitioned by the partitioning plate 383 and the R separating portion 360. Water flowing into one of the right flow passage 380 and the left flow passage 381 thus does not flow into the other of the right flow passage 380 and the left flow passage 381.

Figure 17A:
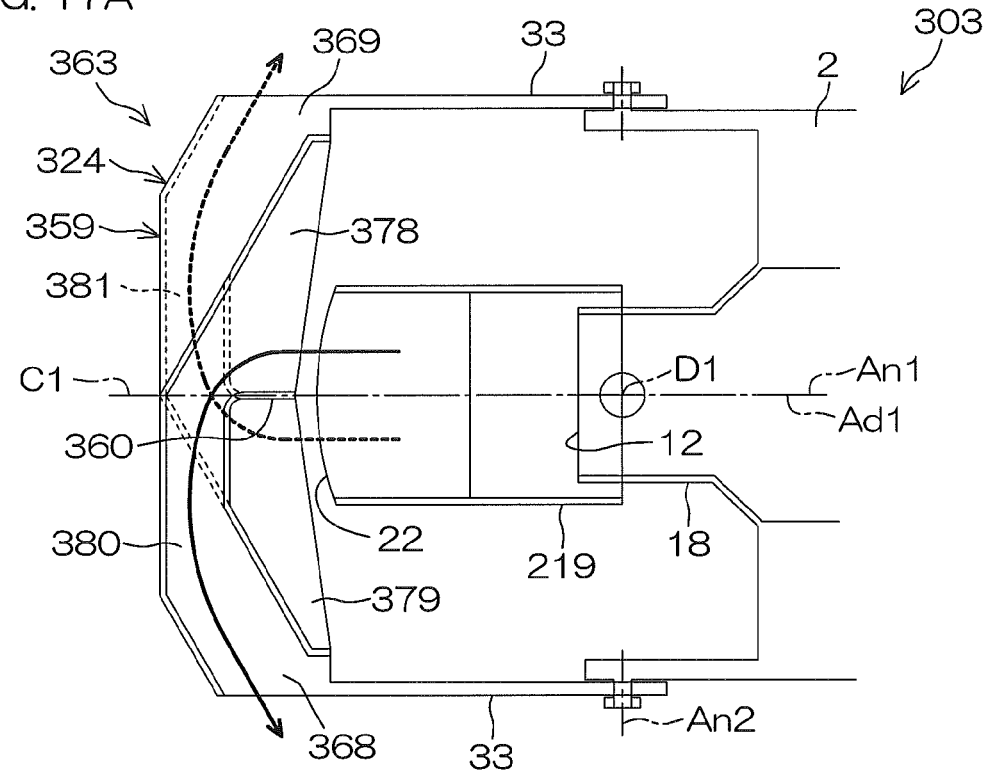
FIG. 17A is a schematic plan view describing water flow in a state in which the R bucket is positioned at the rear of a deflector and the deflector is positioned at a straight drive position.
Figure 17B:
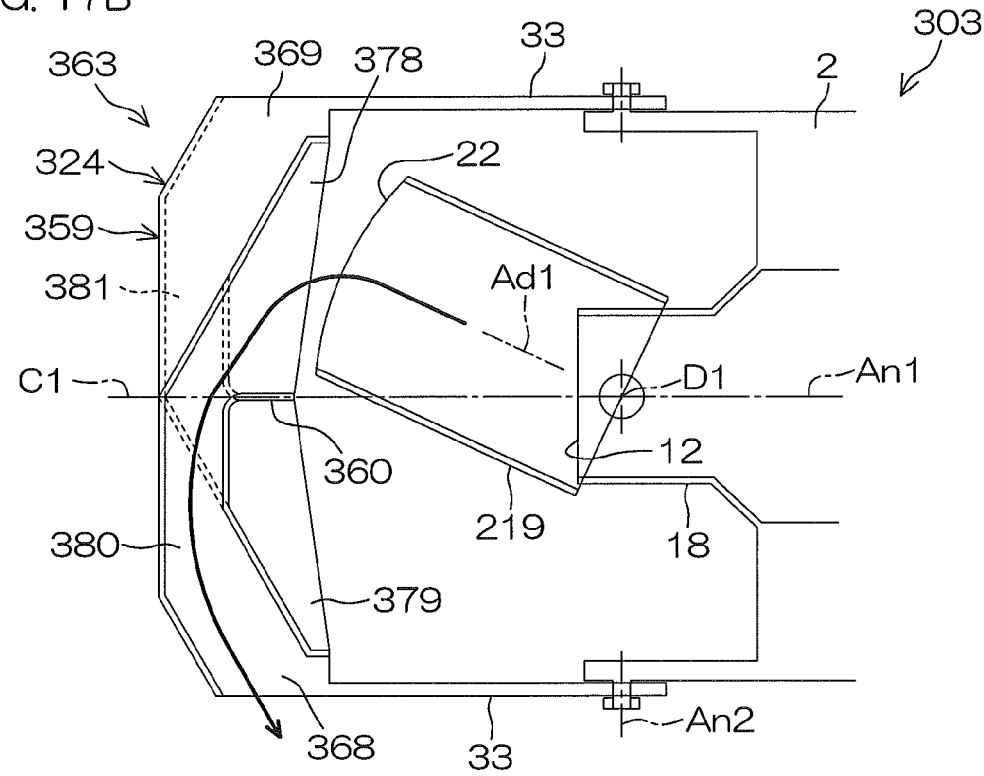
FIG. 17B is a schematic plan view describing water flow in a state in which the R bucket is positioned at the rear of the deflector and the deflector is positioned at a left side.

FIG. 17A is a schematic plan view describing water flow in a state in which the R bucket 324 is positioned at the rear of the deflector 219 and the deflector 219 is positioned at a straight drive position. FIG. 17B is a schematic plan view describing water flow in a state in which the R bucket 324 is positioned at the rear of the deflector 219 and the deflector 219 is positioned at a left side. In FIG. 17A and FIG. 17B, the vessel propulsion apparatus 303 is shown in a transparent state. Thick line arrows shown in FIG. 17A and FIG. 17B indicate directions of water streams.

In the state in which the R bucket 324 is positioned at the rear of the deflector 219 and the deflector 219 is positioned at the straight drive position as shown in FIG. 17A, the water jetted rearward from the deflector 219 is divided to the right and left at equal or substantially equal flow rates by the R separating portion 360. Water of equal or substantially equal flow rates thus flows into the left inlet 378 and the right inlet 379. The water flowing into the left inlet 378 is guided to the R right outlet 368 by the right flow passage 380 and is jetted in the obliquely forward right direction from the R right outlet 368. Likewise, the water flowing into the right inlet 379 is guided to the R left outlet 369 by the left flow passage 381 and is jetted in the obliquely forward left direction from the R left outlet 369.

Thus, in the state in which the R bucket 324 is positioned at the rear of the deflector 219 and the deflector 219 is positioned at the straight drive position, the water flowing into the deflector 219 from the nozzle 18 is divided to the right and left at equal or substantially equal flow rates by the R guide 359. A right branch stream flowing in the obliquely forward right direction and a left branch stream flowing in the obliquely forward left direction are thus generated by the R bucket 324. The R separating portion 360 is disposed, in a plan view, on the central axis Ad1 of the deflector 219 positioned at the straight drive position. The R separating portion 360 thus generates the right branch stream from the water stream flowing to the left side relative to the central axis Ad1 of the deflector 219 and generates the left branch stream from the water stream flowing to the right side relative to the central axis Ad1 of the deflector 219. The obliquely forward right direction is a direction with which the obliquely forward left direction is right/left inverted, and in the above state, the right branch stream and the left branch stream have the same or substantially the same flow rate. Thus, in this state, the right direction component and the left direction component of thrust cancel each other out and only the rear direction component remains.

On the other hand, in the state in which the R bucket 324 is positioned at the rear of the deflector 219 and the deflector 219 is positioned at the left side, the front end of the R separating portion 360 is positioned at the right side relative to the central axis Ad1 of the deflector 219 as shown in FIG. 17B. Thus, when water is jetted rearward from the nozzle 18 in this state, a large portion of the water flowing into the deflector 219 from the nozzle 18 is guided by the right flow passage 380 to the R right outlet 368. The water reaching the R right outlet 368 is jetted in the obliquely forward right direction from the R right outlet 368.

Thus, in the state in which the R bucket 324 is positioned at the rear of the deflector 219 and the deflector 219 is positioned at the left side, a large portion of the water flowing into the deflector 219 from the nozzle 18 is jetted in the obliquely forward right direction from the R right outlet 368. Thus, the right branch stream is caused to have a greater flow rate than the left branch stream. A reverse drive direction thrust that turns the hull 2 rightward is thus generated. In a state in which the deflector 219 is oppositely positioned at the right side, a left branch stream is caused to have a greater flow rate than the right branch stream. A reverse drive direction thrust that turns the hull 2 leftward is thus generated.

The obliquely forward right direction and the obliquely forward left direction are directions that are symmetrical with respect to the central axis An1 of the nozzle 18. The tilt angles of the obliquely forward right direction and the obliquely forward left direction with respect to the central axis An1 of the nozzle 18 are fixed regardless of the steering position of the deflector 219. In contrast, the tilt angle of the central axis Ad1 of the deflector 219 with respect to the central axis An1 of the nozzle 18 changes in accordance with the movement of the deflector 219 around the axis D1. However, at any steering position, the tilt angles of the obliquely forward right direction and the obliquely forward left direction are greater than the tilt angle of the central axis Ad1 of the deflector 219. A thrust having a greater right/left direction component is thus generated. A large force of turning the vessel 1 in the reverse drive state can thus be generated.

Figure 18A:
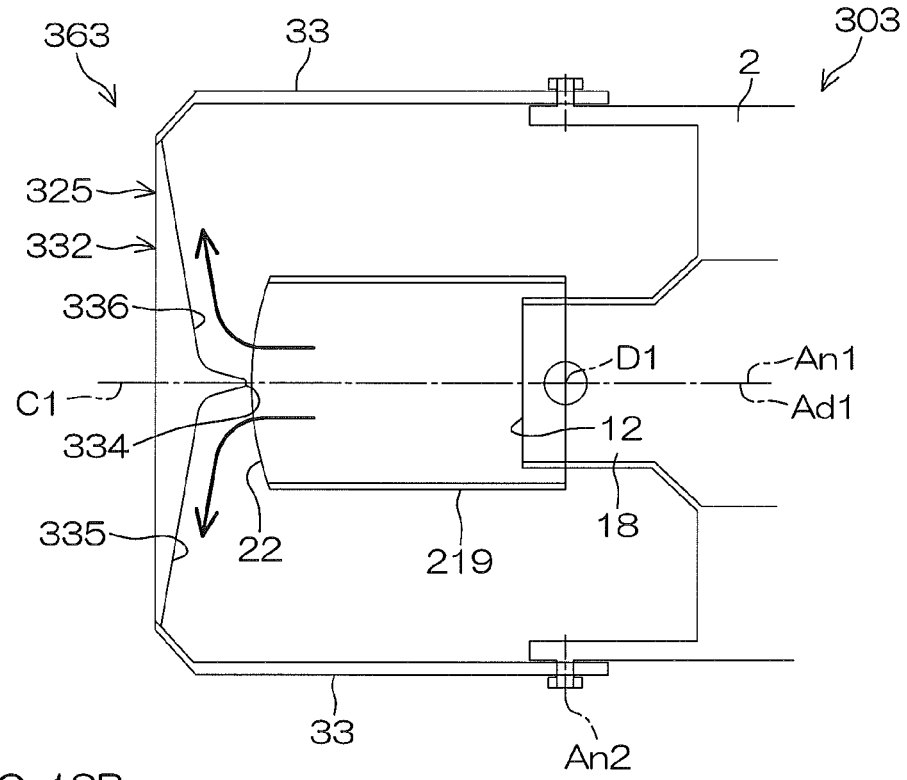
FIG. 18A is a schematic plan view describing water flow in a state in which the F bucket is positioned at the rear of the deflector and the deflector is positioned at the straight drive position.
Figure 18B:
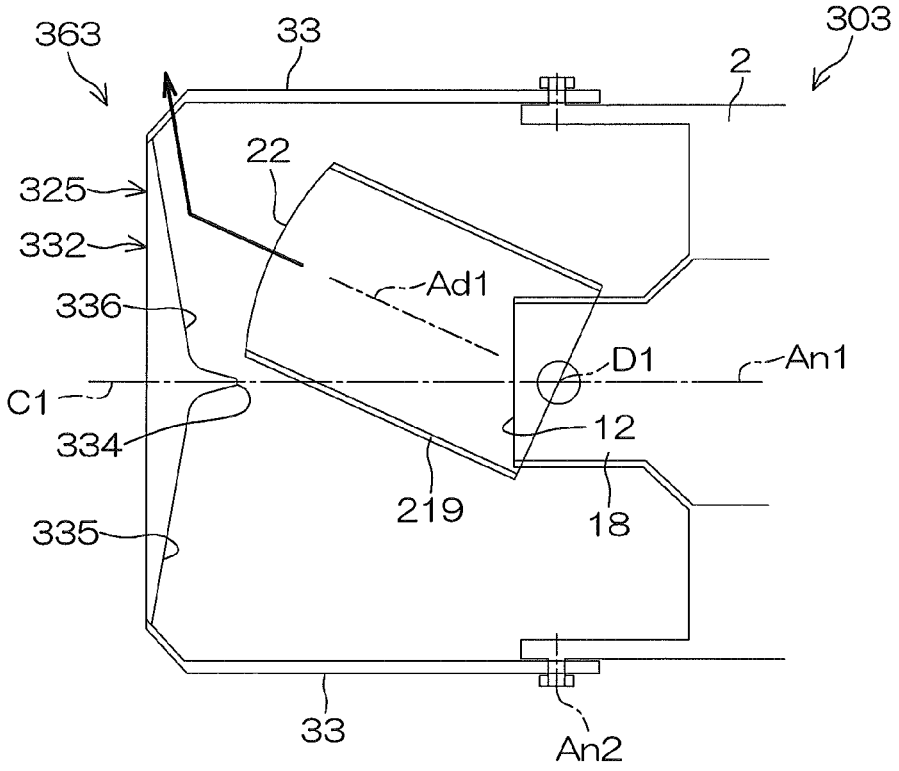
FIG. 18B is a schematic plan view describing water flow in a state in which the F bucket is positioned at the rear of the deflector and the deflector is positioned at the left side.

FIG. 18A is a schematic plan view describing water flow in a state in which the F bucket 325 is positioned at the rear of the deflector 219 and the deflector 219 is positioned at the straight drive position. FIG. 18B is a schematic plan view describing water flow in a state in which the F bucket 325 is positioned at the rear of the deflector 219 and the deflector 219 is positioned at a left side. In FIG. 18A and FIG. 18B, the vessel propulsion apparatus 303 is shown in a transparent state. Thick line arrows shown in FIG. 18A and FIG. 18B indicate directions of water streams.

The F bucket 325 includes a V-shaped F guide 332 that is opened rearward in a plan view. The F guide 332 is right/left symmetrical. The F guide 332 includes an F apex portion 334 disposed on the central axis Ad1 of the deflector 219 positioned at the straight drive position, an F right guide 335 extending obliquely rearward to the right from the F apex portion 334, and an F left guide 336 extending obliquely rearward to the left from the F apex portion 334. The F right guide 335 has a shape with which the F left guide 336 is right/left inverted, and the F right guide 335 and the F left guide 336 are disposed right/left symmetrically. A right side of the F right guide 335 is open and a left side of the F left guide 336 is open.

In a state in which the bucket 363 is positioned between the closed position and the opened position, at least a portion of the F guide 332 faces the F outlet 22. In this state, water jetted rearward from the F outlet 22 is guided in a right guiding direction by the F right guide 335. The water guided by the F right guide 335 is jetted in the right guiding direction from the bucket 363. Likewise, in this state, water jetted rearward from the F outlet 22 is guided in a left guiding direction by the F left guide 336. The water guided by the F left guide 336 is jetted in the left guiding direction from the bucket 363. In FIG. 18A, the right guiding direction is an obliquely rearward right direction and the left guiding direction is an obliquely rearward left direction.

In the state in which the F bucket 325 is positioned at the rear of the deflector 219 and the deflector 219 is positioned at the straight drive position as shown in FIG. 18A, the water jetted rearward from the F outlet 22 is divided to the right and left at equal or substantially equal flow rates by the F guide 332. Specifically, water flowing at the right side relative to the F apex portion 334 is guided in the right guiding direction by the F right guide 335 and water flowing at the left side relative to the F apex portion 334 is guided in the left guiding direction by the F left guide 336. A right branch stream flowing in the right guiding direction and a left branch stream flowing in the left guiding direction are thereby generated by the F bucket 325. The flow rates of the right branch stream and the left branch stream are the same or substantially the same in this state. Thus, the right direction component of thrust and the left direction component of thrust cancel each other out and only the front direction component of thrust remains. A forward drive direction thrust that propels the hull 2 in the forward direction is thus generated.

On the other hand, in the state in which the F bucket 325 is positioned at the closed position and the deflector 219 is positioned at the left side as shown in FIG. 18B, the flow rate of water flowing at the left side relative to the F apex portion 334 is greater than the flow rate of water flowing at the right side relative to the F apex portion 334. The F guide 332 thus causes the left branch stream to have a greater flow rate than the right branch stream in this state. Particularly, in a state in which the deflector 219 is positioned at the left maximum steering position, all of the water jetted from the F outlet 22 flows at the left side relative to the F apex portion 334. Thus, only the left branch stream is generated in this state. A forward drive direction thrust that turns the hull 2 leftward is thus generated. In a state in which the deflector 219 is oppositely positioned at the right side, the right branch stream is caused to have a greater flow rate than the left branch stream. A forward drive direction thrust that turns the hull 2 rightward is thus generated.

FIG. 19A to FIG. 19D are schematic side views describing an example of a relationship of the position of the lever 6 and the positions of the R bucket 324 and the F bucket 325. In FIG. 19A to FIG. 19D, the vessel propulsion apparatus 303 is shown in a transparent state. Thick line arrows shown in FIG. 19A to FIG. 19D indicate directions of water streams. The position of the R bucket 324 shown in FIG. 19A is the closed position of the R bucket 324, and the position of the R bucket 324 shown in FIG. 19C is the opened position of the R bucket 324. Also, the position of the F bucket 325 shown in FIG. 19C is the closed position of the F bucket 325, and the position of the F bucket 325 shown in FIG. 19D is the opened position of the F bucket 325.

In the state in which the lever 6 (see FIG. 1) is positioned in the R region, the ECU 4 (see FIG. 1) positions the bucket 363 at a reverse position (corresponding to the closed positions) as shown in FIG. 19A. The reverse position is a position at which the R bucket 324 faces the F outlet 22 across an interval in the front/rear direction and the entire F outlet 22 is covered by the R bucket 324 in a rear view. Thus, in this state, all of the water flowing into the deflector 219 from the nozzle 18 is jetted rearward from the F outlet 22 and then guided in at least one of either of the obliquely forward right direction and the obliquely forward left direction by the R bucket 324. A thrust in the reverse drive direction is thus generated.

As shown in FIG. 19B, in a state in which the lever 6 is positioned in the N region, the ECU 4 positions the bucket 363 at a neutral position. The neutral position is a position at the opened position side relative to the reverse position, and at this position, only a portion of the F outlet 22 faces the R bucket 324 and the remaining portion of the F outlet 22 faces the F bucket 325. Thus, in this state, all of the water flowing into the deflector 219 from the nozzle 18 is jetted rearward from the F outlet 22 and a portion of the jetted water is guided in at least one of either of the obliquely forward right direction and the obliquely forward left direction by the R bucket 324. The remaining portion is guided in at least one of either of the right guiding direction and the left guiding direction by the F bucket 325.

In a state in which the bucket 363 is positioned at the neutral position and the deflector 219 is positioned at the straight drive position, a right branch stream and a left branch stream flowing in the obliquely forward right direction and the obliquely forward left direction from the R bucket 324 are generated. The flow rates of the right branch stream and the left branch stream are the same or substantially the same in this state and thus the right direction component of thrust and the left direction component of thrust cancel each other out and only the rear direction component of thrust remains.

Likewise, in the state in which the bucket 363 is positioned at the neutral position and the deflector 219 is positioned at the straight drive position, a right branch stream and a left branch stream flowing in the right guiding direction and the left guiding direction from the F bucket 325 are generated. The flow rates of the right branch stream and the left branch stream are the same or substantially the same in this state and thus the right direction component of thrust and the left direction component of thrust cancel each other out and only the front direction component of thrust remains.

The position of the bucket 363 in the state in which the lever 6 is positioned in the N region is set so that the front direction component of thrust and the rear direction component of thrust cancel each other out when the deflector 219 is positioned at the straight drive position. Thus, in this state, no thrust (resultant force) of any direction is generated. On the other hand, in the state in which the deflector 219 is positioned at the right side or the left side, a thrust having a right direction component or a left direction component is generated. Thus, in this state, a force that rotates the hull 2 around the substantially vertical axis passing through the hull 2 is generated and the vessel 1 turns on the spot.

In a state in which the lever 6 is positioned in the low speed region inside the F region, the ECU 4 positions the bucket 363 at a low speed position as shown in FIG. 19C. The low speed position is a position at the opened position side relative to the neutral position, and at this position, the R bucket 324 does not face the F outlet 22 and the F bucket 325 faces only a portion of the F outlet 22. Thus, in this state, all of the water flowing into the deflector 219 from the nozzle 18 is jetted rearward from the F outlet 22 and a portion of the jetted water is guided in at least one of either of the right guiding direction and the left guiding direction by the F bucket 325. The remaining portion passes below the bucket 363. A thrust having a greater front direction component than that generated when the lever 6 is positioned in the N region is thus generated.

In a state in which the lever 6 is positioned in the high speed region (in the third preferred embodiment, a position inside the F region with which the movement amount of the lever 6 is greater than in the low speed region), the ECU 4 positions the bucket 363 at a high speed position corresponding to the opened positions as shown in FIG. 19D. At the high speed position, the bucket 363 is positioned above the F outlet 22 and the entire F outlet 22 is opened. Thus, all of the water flowing into the deflector 219 from the nozzle 18 passes below the bucket 363. A thrust having a greater front direction component than that generated when the lever 6 is positioned in the low speed region is thus generated.

Other Preferred Embodiments

Although preferred embodiments of the present invention have been described above, the present invention is not restricted to the contents of the above-described first to third preferred embodiments and various modifications are possible within the scope of the claims.

For example, with the first to third preferred embodiments described above, a case in which the vessel propulsion apparatus includes the R bucket and the F bucket was described. However, the vessel propulsion apparatus may include only the R bucket and the vessel propulsion apparatus does not have to include an F bucket.

Also, with the first to third preferred embodiments described above, a case in which output adjustment of the vessel propulsion apparatus and movements of the R bucket and the F bucket are performed by operation of a common lever. However, two dedicated levers may be provided instead. That is, a throttle lever operated for adjusting the output of the vessel propulsion apparatus and a shift lever operated for adjusting the positions of the R bucket and the F bucket may be provided. An R shift lever for adjusting the position of the R bucket and an F shift lever for adjusting the position of the F bucket may be provided.

Also, with the first to third preferred embodiments described above, a case in which the number of jet pumps included in the vessel propulsion apparatus is one was described. However, the vessel propulsion apparatus may include a plurality of jet pumps.

Also, with the first to third preferred embodiments described above, a case in which the vessel is a boat was described. However, the vessel may instead be a personal watercraft that includes a saddle type seat.

The present application corresponds to Japanese Patent Application No. 2012-050907 filed on Mar. 7, 2012 in the Japan Patent Office, the entire disclosures of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

a nozzle which jets water rearward;

a deflector rotatable to the right and to the left around a substantially vertical axis and between a right maximum steering position and a left maximum steering position, the deflector including an outlet which jets water jetted from the nozzle in a rearward direction or an obliquely rearward direction tilted to the right or to the left with respect to the rearward direction;

a reverse bucket rotatable up and down around a substantially horizontal axis and between a closed position covering at least a portion of the outlet in a rear view of the vessel propulsion apparatus and an opened position not covering the outlet; and a guide that generates a right branch stream flowing in an obliquely forward right direction and a left branch stream flowing in an obliquely forward left direction by dividing water flowing into the deflector from the nozzle to the right and to the left at equal or substantially equal flow rates in a state in which the reverse bucket is positioned at the closed position and the deflector is positioned at a straight drive position between the right maximum steering position and the left maximum steering position; wherein the left branch stream has a greater flow rate than the right branch stream in a state in which the reverse bucket is positioned at the closed position and the deflector is positioned at a right side relative to the straight drive position;

the right branch stream has a greater flow rate than the left branch stream in a state in which the reverse bucket is positioned at the closed position and the deflector is positioned at a left side relative to the straight drive position;

the substantially horizontal axis is an axis fixed with respect to the deflector; and the guide generates the left branch stream from a water stream that flows further to the left than a central axis of the deflector and generates the right branch stream from a water stream that flows further to the right than the central axis of the deflector in the state in which the reverse bucket is positioned at the closed position and the deflector is positioned at the straight drive position.

2. The vessel propulsion apparatus according to claim 1, wherein the reverse bucket includes a lid portion covering the outlet when the reverse bucket is in the closed position; and the guide is a portion of the reverse bucket and includes a plate-shaped member extending forward from the lid portion.

3. The vessel propulsion apparatus according to claim 2, wherein the deflector includes a main flow passage which guides water jetted from the nozzle rearward toward the outlet, a right flow passage extending obliquely forward to the right and downward from the main flow passage to a right outlet, and a left flow passage extending obliquely forward to the left and downward from the main flow passage to a left outlet; and in a state in which the reverse bucket is positioned at the closed position, the deflector and the reverse bucket generate the right branch stream to flow through a flow passage defined by a portion of the main flow passage at a right side relative to the plate-shaped member, a portion of the lid portion at a right side relative to the plate-shaped member, and the right flow passage; and generate the left branch stream to flow through a flow passage defined by a portion of the main flow passage at a left side relative to the plate-shaped member, a portion of the lid portion at a left side relative to the plate-shaped member, and the left flow passage.

4. The vessel propulsion apparatus according to claim 3, wherein in the state in which the reverse bucket is positioned at the closed position, the deflector and the reverse bucket generate the right branch stream to pass through the outlet and generate the left branch stream to pass through the outlet.

5. The vessel propulsion apparatus according to claim 2, wherein the deflector includes a slit and the plate-shaped member extends into an interior of the deflector through the slit.

6. The vessel propulsion apparatus according to claim 1, wherein the guide is a portion of the reverse bucket and guides water jetted rearward from the deflector in an obliquely forward left direction and an obliquely forward right direction in the state in which the reverse bucket is positioned at the closed position and the deflector is positioned at the straight drive position.

7. The vessel propulsion apparatus according to claim 6, wherein the guide includes an apex portion positioned on a central axis of the deflector in the state in which the reverse bucket is positioned at the closed position and the deflector is positioned at the straight drive position, a U-shaped right guide extending obliquely rearward to the right from the apex portion and then extending obliquely forward to the right, and a U-shaped left guide extending obliquely rearward to the left from the apex portion and then extending obliquely forward to the left.

8. The vessel propulsion apparatus according to claim 1, wherein a front end of the guide is disposed further rearward than the substantially vertical axis.

9. The vessel propulsion apparatus according to claim 1, wherein a front end of the guide is disposed further rearward than a rear end of the nozzle.

* * * * *